US009797123B2

(12) United States Patent
Ryan et al.

(10) Patent No.: US 9,797,123 B2
(45) Date of Patent: Oct. 24, 2017

(54) DWELLING

(71) Applicant: Purepods Limited, Akaroa (NZ)

(72) Inventors: Grant Ryan, Akaroa (NZ); Peter Higgins, Christchurch (NZ)

(73) Assignee: Purepods Limited, Akaroa (NZ)

( * ) Notice: Subject to any disclaimer, the term of this patent is extended or adjusted under 35 U.S.C. 154(b) by 0 days.

(21) Appl. No.: 14/653,796

(22) PCT Filed: Dec. 24, 2013

(86) PCT No.: PCT/IB2013/061301
§ 371 (c)(1),
(2) Date: Jun. 18, 2015

(87) PCT Pub. No.: WO2014/102716
PCT Pub. Date: Jul. 3, 2014

(65) Prior Publication Data

US 2015/0345126 A1 Dec. 3, 2015

(30) Foreign Application Priority Data

Dec. 24, 2012 (NZ) ..... 605325

(51) Int. Cl.
*E04B 1/00* (2006.01)
*E04B 1/02* (2006.01)
(Continued)

(52) U.S. Cl.
CPC ..... *E04B 1/02* (2013.01); *E03B 3/02* (2013.01); *E04B 2/56* (2013.01); *E04B 5/02* (2013.01);
(Continued)

(58) Field of Classification Search
CPC ..... E04H 1/00; E04C 2/54; E04B 5/46; E04B 1/3408; E03B 3/02; E04D 13/03; E04D 3/28
See application file for complete search history.

(56) References Cited

U.S. PATENT DOCUMENTS 3,354,590 A * 11/1967 Gilroy ..... E04B 1/24 52/299
3,411,250 A * 11/1968 Maymont ..... E04B 1/34 52/292
(Continued)

FOREIGN PATENT DOCUMENTS

CN 202324688 U 7/2012
JP 06-158730 A 6/1994
(Continued)

OTHER PUBLICATIONS

International Search Report and Written Opinion dated Apr. 14, 2014, International Patent Application No. PCT/USIB2013/061301 with International Filing Date of Dec. 23, 2013, (11 pages).

*Primary Examiner* — Gisele Ford
(74) *Attorney, Agent, or Firm* — Stephen M. De Klerk

(57) ABSTRACT

A terrestrial dwelling (1) including a floor (2) with at least one floor section (3) orientated substantially horizontally in use. The dwelling includes at least one wall (4), including at least one wall section (5) projecting substantially upwardly from the floor section (3). A dwelling support (6) is configured to at least partially elevate the floor section (3) above a terrain surface (15). A roof (7) with at least one roof section (8) is attached to an upper portion of said wall (4) wherein the dwelling (1) is configured to provide at least partial atmospheric transparency to at least partially allow atmospheric elements including light incident on the dwelling (1) above the floor (2) to reach the terrain surface (15) under the dwelling (1).

19 Claims, 18 Drawing Sheets

(51) Int. Cl.

| | |
|---|---|
| ***E04B 2/56*** | (2006.01) |
| ***E04B 5/02*** | (2006.01) |
| ***E04B 5/46*** | (2006.01) |
| ***E04B 7/02*** | (2006.01) |
| ***E04C 2/54*** | (2006.01) |
| ***E04H 1/00*** | (2006.01) |
| ***E03B 3/02*** | (2006.01) |
| ***E04H 1/02*** | (2006.01) |
| *E04C 2/00* | (2006.01) |
| *E04B 1/34* | (2006.01) |

(52) U.S. Cl.

CPC ..... *E04B 5/46* (2013.01); *E04B 7/022* (2013.01); *E04C 2/54* (2013.01); *E04H 1/00* (2013.01); *E04H 1/02* (2013.01); *E04B 1/3408* (2013.01); *E04C 2002/005* (2013.01)

(56) References Cited

U.S. PATENT DOCUMENTS 3,524,287 A * 8/1970 Toselli ..... E04B 1/3408 52/299
3,562,974 A * 2/1971 Niemeyer ..... E04B 1/3408 52/236.1
3,685,221 A * 8/1972 Mangan ..... E04B 1/19 52/175
3,872,632 A * 3/1975 Snibbe ..... E04B 1/3408 52/73
3,913,285 A * 10/1975 Helfrich ..... E04B 1/3408 52/169.4
3,943,671 A * 3/1976 Curci ..... E04B 1/3408 52/169.1
4,020,989 A * 5/1977 Kautz ..... A01G 9/1469 126/616
4,141,498 A * 2/1979 Marschner ..... F24D 11/003 126/628
4,242,833 A * 1/1981 Maes, Jr. ..... A01G 9/22 47/17
4,741,123 A * 5/1988 Gauthier ..... A01G 9/247 47/21.1
4,807,418 A * 2/1989 Ferguson ..... E02D 27/00 52/169.4
4,934,404 A * 6/1990 DeStefano ..... A01G 25/00 137/236.1
5,212,903 A * 5/1993 Talbott ..... A01G 9/242 239/242
5,493,825 A 2/1996 Gaston
5,715,636 A * 2/1998 Taylor ..... E04B 5/46 428/428
6,182,408 B1 * 2/2001 Poehler ..... E04H 1/02 52/200
6,941,702 B1 * 9/2005 Abrams ..... E03B 1/041 108/25
7,207,748 B1 * 4/2007 Urban ..... A01G 25/00 137/357
7,788,876 B2 * 9/2010 Yasui ..... A01G 9/1415 236/44 A
7,992,350 B2 * 8/2011 Vriens ..... E04B 1/3211 52/40
8,371,073 B2 * 2/2013 Fuller ..... E04F 17/00 52/173.3
D728,822 S * 5/2015 Ryan ..... D25/15
2005/0105970 A1 * 5/2005 Faris ..... A01G 13/0206 405/41
2006/0130410 A1 * 6/2006 Isisaki ..... A01G 9/1415 52/12
2008/0010940 A1 * 1/2008 Sun ..... E04B 1/3408 52/745.17
2009/0100773 A1 * 4/2009 Flynn ..... B29C 67/0044 52/306
2010/0263295 A1 * 10/2010 Flanagan ..... E03B 3/02 52/1
2010/0275526 A1 11/2010 Sun
2010/0288375 A1 * 11/2010 Thomas ..... E03B 3/03 137/358
2011/0005602 A1 * 1/2011 Harrington ..... E03B 1/04 137/1
2011/0017301 A1 * 1/2011 Canavan ..... E04B 2/88 137/1
2011/0315253 A1 * 12/2011 David ..... E03B 3/02 137/565.01
2012/0090251 A1 * 4/2012 Andreini ..... E04C 2/328 52/81.6
2014/0346099 A1 * 11/2014 Brantley ..... A01G 25/00 210/127

FOREIGN PATENT DOCUMENTS

JP 06-066036 A 3/1998
JP 11-062279 A 3/1999

* cited by examiner

DWELLING

CROSS-REFERENCE TO OTHER APPLICATIONS

This is a National Phase of International Application No. PCT/IB2013/061301 filed on Dec. 24, 2013, which claims priority from New Zealand Patent Application No. 605325, filed on Dec. 24, 2012.

TECHNICAL FIELD

The present invention relates generally to a building, shelter, dwelling or the like. In particular, the present invention relates to buildings possessing at least partial visual, environmental or atmospheric transparency.

BACKGROUND ART

Environmental awareness has become increasingly prominent in the mainstream consciousness of governments, companies, organisations and individuals. Recognition of the need to minimize the impact of human activities and our habitations on the environment are being incorporated as a significant metric in assessing the viability of many new buildings, particularly in areas of recognised natural beauty, sensitivity and/or rarity.

Many countries now place strict conditions for the erection of any structure, shelter, or habitation in such areas of high conservation value. Planning restrictions, consents, covenants, and myriad other forms of restrictions may apply not only to the structure's nature and configuration but also the on-site effects of its construction method.

It is widely held as self-evident that such regulatory and even statutory restrictions used to safeguard the environment will become even more prevalent and pervasive in the future. In some regions, even placement of a tent or the regular parking of campervan/motorhomes on the same position for more than a short period is prohibited due to the detrimental deprivation of light and moisture on the flora and fauna covered by the tent/campervan.

However, the very same facets of the environment that are at the heart of such protective measures are also the main reasons people are attracted to such areas.

There is thus a paradox in trying to prevent any adverse impact from humans in areas of recognised beauty and attractiveness, whilst simultaneously seeking to avoid impairing the actual enjoyment experienced by being in the area.

Attempts have been made to provide a minimal impact on the earth's surface by use of unorthodox structures such as tree-houses, suspended tents and the like. While their elevation from the ground does allow the atmospheric elements uninterrupted passage to the ground underneath, they pose significant practicality complications which would deter many users. It would thus be desirable to provide a structure or dwelling capable of a minimal impact on its environment.

Whilst hiking, mountain biking, trail running, kayaking and the like can all bring humans into temporary or periodic contact with the countryside, it is nevertheless necessary to provide some form of shelter to enable humans to enjoy a more prolonged exposure to the countryside, particularly for overnight periods. Many forms of shelters have been devised to provide accommodation for recreational/leisure pursuits. Such recreational shelters are intended to provide at least some enhancement its user's experience of their environment, in contrast to application-specific structures such as emergency shelters, military, civil engineering, industrial or administrative structures for example.

However, such existing recreational structures face the antagonistic design requirements of exposing the users to the environment, whilst also protecting them from inclement or adverse weather. Typically, increasing the weather protection and comfort of a structure results in an increased structure weight and cost as more substantial material and techniques (e.g. solid walls and roofs, windows, decking, verandas, foundations, permanent beds, furniture, toilets and kitchen utilities) are incorporated. Inevitably, construction techniques such as solid walls and the like separate the occupants from direct immersion in their environment.

A direct immersion in the environment can be achieved by non-permanent structures such as bivouacs, tents, and so forth. However, tents and bivouacs are typically considered uncomfortable, compromised or restrictive in inclement conditions, requiring sealing of the entranceways and openings and thus obturating the users from their environment.

The capacity to witness and be exposed to the dynamics and visuals of bad weather whilst being sheltered in comfort holds strong appeal for many people. Indeed, the degree to which a dwelling allows an occupant to see, feel, smell, and/or touch the environment can be instrumental to their connection with, and sense of enjoyment of, the environment. Ideally, a recreational dwelling would protect occupants from wind, rain, and excessive cold or heat, while still allowing the occupants a feeling of immersion with their surroundings.

It would thus be highly desirable to provide a recreational dwelling capable of a minimal impact on its environment whilst protecting occupants from inclement weather.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to a preferred aspect, the present invention provides a terrestrial dwelling including:

- a floor including at least one floor section, orientated substantially horizontally in use;

at least one wall including at least one wall section, projecting substantially upwardly from said floor section;

a dwelling support, configured to at least partially elevate the floor section above a terrain surface, wherein said dwelling is configured to provide at least partial atmospheric transparency.

Atmospheric transparency as used herein refers to the capacity of the dwelling to at least partially allow atmospheric elements incident on the dwelling above the floor to reach the terrain surface under the dwelling. Thus, the dwelling is in effect at least partially atmospherically transparent insofar as the net effect on any flora and fauna (i.e. the biota) located on the terrain surface under the dwelling. The sub-dwelling biota therefore experiences substantially equivalent atmospheric conditions under the dwelling as the uncovered biota adjacent to the dwelling. It can be seen therefore that despite its presence, the dwelling contributes a minimal effect on its environment.

Preferably said dwelling also includes a roof including at least one roof section attached to an upper portion of said wall. However, it should be understood the dwelling is not restricted to any specific configuration of walls and/or a roof.

As an illustration, a dwelling configuration such as a 'lean-to' may combine the function and role of both a wall and roof section and as such are incorporated within the scope of the invention.

Said dwelling may be configured with any desired facilities according to its intended purpose, e.g. recreational, residential, administration and so forth. According to one embodiment, said dwelling includes one or more of a:

toilet;

bed;

cooking facilities;

washbasin;

Shower or bath;

plumbing;

heating source.

According to one embodiment, said dwelling support includes at least one floor section support, located beneath at least one floor section to support and at least partially elevate the floor section above the terrain surface. In an alternative embodiment, the dwelling support includes at least one suspension element, configured in use to suspend the dwelling from an anchor point affixed to the terrain surface. The dwelling may thus be suspended from one or more trees, above a ravine, stream or from the side of a ledge or the like.

The dwelling may be configured with a floor substantially coterminous with said wall sections or have one or more floor sections projecting beyond the perimeter of the wall sections to form decking, walkways or the like. In either case, the outer perimeter of the floor presents a dwelling footprint which defines the overlapping coverage of the dwelling over the terrain surface in plan view.

According to one aspect, said dwelling configuration is atmospherically transparent to at least one (and preferably two or more) atmospheric elements selected from the group comprising;

rain and/or any other forms of airborne moisture;

light, and wind.

The above-described atmospheric elements are key components affecting the sustainability of any life forms present under the dwelling. As the floor of the dwelling is at least partially elevated above the terrain surface, it is clearly possible to allow wind to pass underneath simply by ensuring at least a portion of the dwelling perimeter under the floor is open, allowing airflow therethrough.

In contrast however, the persistent obstruction of sunlight and/or moisture is typically terminal for plants. Whilst some plant and fungus may grow in moist environments without direct sunlight, it will be readily appreciated that the creation of such an environment by placement of a dwelling is nevertheless significantly altering the environment.

To allow incident light to reach the terrain surface under the dwelling, either the light must be deflected or reflected around the floor and walls or pass through the dwelling.

Glazed or otherwise transparent materials are well known for use in construction for windows, doors, skylights, panels and even roofs. It is unusual however to employ such materials for flooring purposes. Glass panels have been employed as flooring in specialised instances such as observation portals in overhanging sections of high towers, bridges, walkways or stairs. The intended primary purpose of such panels is to permit human observation of the area below the panel and not to permit the passageway of light to support organic life beneath.

According to one embodiment, at least one said floor section is transparent.

Preferably, at least one wall section is transparent.

According to one embodiment, at least one roof section is transparent.

Preferably, said transparent floor section and transparent wall section are mutually positioned to at least partially allow light incident on the transparent wall section to reach the terrain surface under the floor by passing through said transparent floor section.

Preferably, said transparent floor section and transparent roof section are mutually positioned to at least partially allow light incident on the transparent roof section to reach the terrain surface under the floor by passing through said transparent floor section.

The transparent wall sections may be formed as windows, doors, complete wall panels or any combination of same.

Although elevated buildings are well known (e.g. hillside dwellings built on piles, support beams and the like) and substantially transparent buildings are known (e.g. greenhouses), it is not known to combine both characteristics for the specific purpose of allowing sunlight to pass through the dwelling and fall on the terrain surface below.

It will be appreciated that depending on the local climate and on a dwelling's configuration and orientation sufficient rain and other airborne moisture may be deposited underneath the dwelling to allow plants to grow.

To minimise the impact of the dwelling on the biota beneath the floor, it will be appreciated however that the same quantity and distribution of the moisture that would otherwise have been received on the terrain surface needs to be provided. Thus, according to a further aspect of the present invention, said dwelling is configured to provide at least partial atmospheric transparency to atmospheric elements in the form of rain and/or any other forms of airborne moisture.

When moisture, e.g. rain, strikes a non-absorbent surface of any structure, the moisture follows the most direct gravitational path downwards. Typically, rain water run-off from roofs is collected at a periphery by guttering before being channelled down a wall via a downpipe to a storm water system (if present), rain collection tank, detention tank, and/or discharged directly into the local environment.

Clearly a potentially large volume of water discharged from a point source (e.g. a drainpipe outlet) can cause erosion and/or flooding problems without careful management and maintenance. Moreover, such arrangements clearly have a detrimental impact on the environment by artificially drying the area under the building and increasing the water deposited at the storm water discharge point.

The present invention substantively ameliorates these difficulties by allowing the rainwater incident on at least a portion of the dwelling to be routed around the dwelling and re-dispersed underneath the floor onto the terrain surface below.

According to one embodiment, the dwelling is configured to divert the moisture incident on at least one:

- roof section;
- wall section, and/or
- uncovered floor section forming a walkway or deck area exterior to the dwelling's wall sections, to be re-dispersed under the floor onto the terrain surface below.

The incident moisture may be diverted by any convenient method including, but not limited to;

- collecting roof run-off in at least one roof periphery gutter;
- allowing roof run-off to travel down a wall section;
- allowing roof run-off to drip into collectors located substantially at the floor level;
- collecting roof run-off into a water storage or detention tank;
- transferring moisture run-off from the roof and/or walls to one or more apertured conduits, drippers, sprinklers, or other irrigation distribution system beneath the elevated floor, and/or
- any combination or permutation of same.

Possible configurations to facilitate the transfer of the incident moisture to the terrain surface under the dwelling floor may range from simple, gravity-operated conduits to more elaborate fluid distribution systems. Clearly, for the example of a simplified, minimalist dwelling placed in a remote location without a connection to the national power grid, a maintenance-free, gravity operated system offers attractions.

Alternative adaptations that may be applicable in such situations include a degree of electro-mechanical intervention in the distribution and the timing/volume control of the moisture, preferably powered by a self-sustaining source such as a solar photovoltaic panel.

In simplified applications, the water collected from the incident moisture may simply be channelled along a network of small diameter irrigation tubing with a plurality of small, evenly-spaced outlets to facilitate a uniform distribution of the fluid over the terrain surface.

In one embodiment, the irrigation tubing may conveniently be attached to support joists located underneath the floor sections.

It will be appreciated that when the dwelling construction includes a predominance of transparent wall sections and floor sections, the occupants can even witness the moisture from the roof and walls being re-distributed underneath the dwelling.

In a further embodiment, the collected moisture may be temporarily stored in a detention tank that provides a water reserve for drinking and bathing/showering. The detention tank would thus operate to fill to a predetermined level, whereupon any excess collected fluid bypasses, or overspills from the tank straight to fluid irrigation outlets beneath the dwelling. Any grey water produced by the bathing/showering can also be diverted straight to the irrigation system, provided any soaps or detergent agent used are compatible with the appropriate environmental restrictions for that area. The next rainfall will then re-fill the detention tank to said predetermined level before being diverted to the irrigation outlets.

The biota present below the dwelling is thus still provided with a substantially comparable degree of moisture and light to that received without the presence of the dwelling. This greatly minimises the impact of the dwelling on the environment, to the extent that even a tent or campervan positioned in the same location would cause greater environmental harm. It can be thus seen that the present invention offers the ability for users to enjoy the comfort of sheltered accommodation in areas of high natural beauty without the accommodation damaging the very environment that attracted the users.

The present invention may be further optimised to provide the occupants with immersion in their environment, while maintaining a minimal environmental footprint.

Forming the dwelling as a relatively small structure, e.g. holiday accommodation suitable for two occupants, enables the dwelling to be placed in restricted spaces of environmental interest unfeasible for conventional buildings, such as in woodlands, near streams, gullies, small islands and so on.

A small size and lightweight construction not only results in less construction materials (and thus a small environmental manufacturing cost) but also reduces the weight of the dwelling. Conventional construction methods typically require the use of heavy permanent materials (e.g. bricks, concrete, wooden wall cladding, tiled roofing etc.) to ensure durability and weather resistance with a commensurate need for foundations with an appropriate load capacity. Common foundation methods such as strip, slab, pad, raft or pile foundations all require appreciable earthworks. Not only is the terrain surface covered by the actual footprint of the building permanently altered, there is usually a significant disruption to the terrain around the building perimeter during construction. In contrast, the dwelling according to present invention is capable of being supported above the terrain by a variety of techniques which have a negligible impact on the environment.

As previously discussed, the dwelling may be suspended above the terrain surface by one of more suspension elements, attached to anchor points affixed to the terrain surface. The anchor points may be any appropriate natural features such as trees, rock features or outcrops and/or purpose-made ground anchors, rock bolts or the like. Such fittings may be secured in position with minimal disturbance to the environment and require negligible installation time.

The majority of settings would however typically use a non-suspended dwelling, where the dwelling support is formed from at least one floor section support, located beneath at least one floor section to support to at least partially elevate the floor section above a terrain surface. In such configurations the dwelling may be secured to the terrain surface by one or more terrain mounts in the form of micro piles, spikes or similar ground-piercing fittings. The terrain mounts may be separate, discrete elements, to which the floor section supports are attached, or be formed as continuous elements whereby the terrain mounts are incorporated as part of the floor section supports and formed as a single element. In either configuration, the terrain mounts are first inserted into the terrain surface to act as secure mounting points on which dwelling is secured.

According to one embodiment, the dwelling is formed as a substantially rigid skeletal frame to which floor sections, wall sections and roof sections are attached. Although such framing is ideally suited to the properties of steel, alternatives such as wood, or composites are also possible. The use of a skeleton framework with attached cladding of (predominately transparent) panels also facilitates modular construction, whereby variations in the size, layout and orientation of the dwelling components may be readily produced by various permutations and combinations of the modules without substantial re-design. The minimalistic nature of the construction also minimises unnecessary environmental impact by minimising the quantity of material resources required, and the time to manufacture the components and assemble the final dwelling. The light-weight modular construction of the dwelling also aides ease of transportation. The whole dwelling can be shipped to site in a kit-form for assembly, or pre-assembled and fitted straight onto the terrain mounts from a truck or even by helicopter.

Preferably the floor, wall and roof sections are predominately transparent. In order to meet what is widely considered to be a minimum standard of comfort, recreational accommodation is expected to include at least a:

toilet;

personal washing/bathing facility, and bed.

Regardless of whether the dwelling is located in a position with complete privacy, incapable of being overlooked by third parties, most users would still prefer to use a toilet that is not visible through transparent walls. There is consequently no need to form at least the wall sections or floor sections bounding the toilet with transparent material.

Similarly, it is impractical to make a bed from transparent materials and thus the bed floor panel immediately below the bed need not necessarily offer any advantages by being transparent. It is an unavoidable practical consideration that various utilities and services are more readily routed through a conventional non-transparent wall section.

Thus, according to one embodiment of the present invention, the dwelling includes a bathroom area with opaque wall sections. The remainder of the dwelling may be formed from transparent panels such as glass, transparent plastics, Perspex or similar, to provide the occupants with substantially unimpeded visibility of the environment.

Although the wall section surrounding a shower may optionally be made opaque or translucent, users may, according to personal taste and proclivities, prefer to have a transparent bathing and/or showering experience. This may be provided in a number of different arrangements.

In a more conservative arrangement, the shower may be configured with opaque or translucent walls, whilst the shower floor and/or roof is transparent. This allows more privacy, whilst allowing the user to see the terrain below and sky above whilst showering.

A bath may likewise be made with a transparent base and/or sides. According to preference, the bath may be placed either;

on the dwelling floor, inside the walls or on an exterior deck, or recessed into the dwelling floor, either inside the walls or on an exterior deck.

Temperature regulation inside the dwelling may be provided by numerous conventional means. Due to the relatively small volume of the dwelling, a compact gas, liquid or solid fuel burner can provide sufficient heat during cold weather. In site with an electrical power supply, reverse-cycle air-conditioning units may provide temperature control at both extremes. Excess sunlight may be regulated to avoid overheating or glare by internal blinds. The user-controllability of blinds also caters well for different privacy requirements according to the specifics of the location and/or users preferences.

In addition to shading sunlight, temperature and humidity may be regulated by opening/closing doors or windows and/or vents. In high humidity environments where heating is not a primary consideration, portions of the dwelling walls and/or floor may be formed as apertured sections, such as a mesh, grid, latticework, framework or the like. Such materials may also be used for decking and walkway portions in any climate.

Buildings with substantially transparent walls are already known in the art, such as green-houses for sheltered plant growth and accommodation buildings. They do not however provide the following capacities to further immerse to occupants in their environment, namely:

the transparent roof provides an untrammelled view of the day and night sky;

the transparent floor sections, in conjunction with the elevated position of the floor above the terrain surface, allow the occupants to see directly and obliquely downwards to see the environment immediately underneath and surrounding the dwelling. The occupant's elevated position, viewing the surrounding scenery though a substantially transparent structure engenders a feeling akin to floating above the environment, without being too high to feel immersed and connected to the surrounding environment.

some of the wall sections and roof sections may be configured to be retractable, openable and/or removable in benign weather to further remove any barriers between the occupants and their surroundings.

There are tangible advantages in positioning the dwelling within a certain elevation above the terrain surface below. If this distance is too high;

the occupants must negotiate some form of ascent/decent system such as ladders, stairs, or lift systems. This can be burdensome and cumbersome for the occupants, particularly if the site requires a steep climb to ingress/egress the dwelling;

there is an increased risk of injury of a fall from a significant height;

there is a detachment of the occupant from feeling connected to the environment and instead gives a perspective analogous to being in a plane, tower, or other 'man-made' vantage point.

building compliance regulations typically prescribe some form of barrier for any living spaces elevated more than a predetermined height. Thus, any walkways, stairs, deck areas, or parts of the house that can be opened such as sliding doors, would require a protective guard rail, fence, barrier, balustrade or the like. Such protective measures not only add to the cost and complexity of the dwelling, they add yet another obstruction between the occupants and the environment.

However, a difficulty in placing the dwelling sufficiently close to the terrain surface to avoid the above draw-backs has hitherto resulted in an unavoidable impact on the environment as described previously.

Thus, according to one aspect of the present invention, said dwelling is elevated above the terrain surface by a vertical distance such that at least part of the floor is below the regulatory maximum drop height requiring a protective barrier for the location of the dwelling.

Whilst the specific figures for a maximum drop height without a barrier vary between countries (e.g. New Zealand has a maximum drop height of 1 m) it has been found that the drop height should be less than approximately 1.5 m and more preferably less than 1.1 m. It will be appreciated that the terrain surface may not be uniformly level and that non-exposed portions of the dwelling may exceed that drop height without departing from the scope of the invention.

The present invention thus provides an environmentally friendly, primarily recreational accommodation, capable of even being sited in areas of environmental sensitivity without adversely impacting its building site, and without depriving the biota beneath the dwelling from the environmental elements, rain, sunlight and wind. In essence the dwelling is transparent to the atmosphere, generating less impact on-site than a tent or motorhome.

As used herein, the following terms are defined as follows

'Dwelling';—includes any habitable structure, building, shelter, cabin, house, crib, bach, including recreational and non-recreational dwellings.

'Moisture';—includes any airborne moisture, mist, fog, rain, spray, and/or drizzle.

'Wind';—includes any atmospherically created air movements.

'light';—includes direct, reflected, indirect, and/or scattered sunlight and/or moonlight.

'Transparent', 'transparent panels, 'transparent materials';—includes material that are transparent to at least one of light, moisture and wind, said materials including glass, and any clear plastics, acrylics and the like. Other non-opaque materials, gratings, mesh, latticework, perforated panels, netting and the like may also be used in parts of the dwelling as transparent panels, though it will be appreciated that at least the transparent roof sections are only formed from solid, non-perforated transparent materials.

BRIEF DESCRIPTION OF DRAWINGS

Further aspects and advantages of the present invention will become apparent from the following description which is given by way of example only and with reference to the accompanying drawings in which.

BEST MODES FOR CARRYING OUT THE INVENTION

Figure 1:
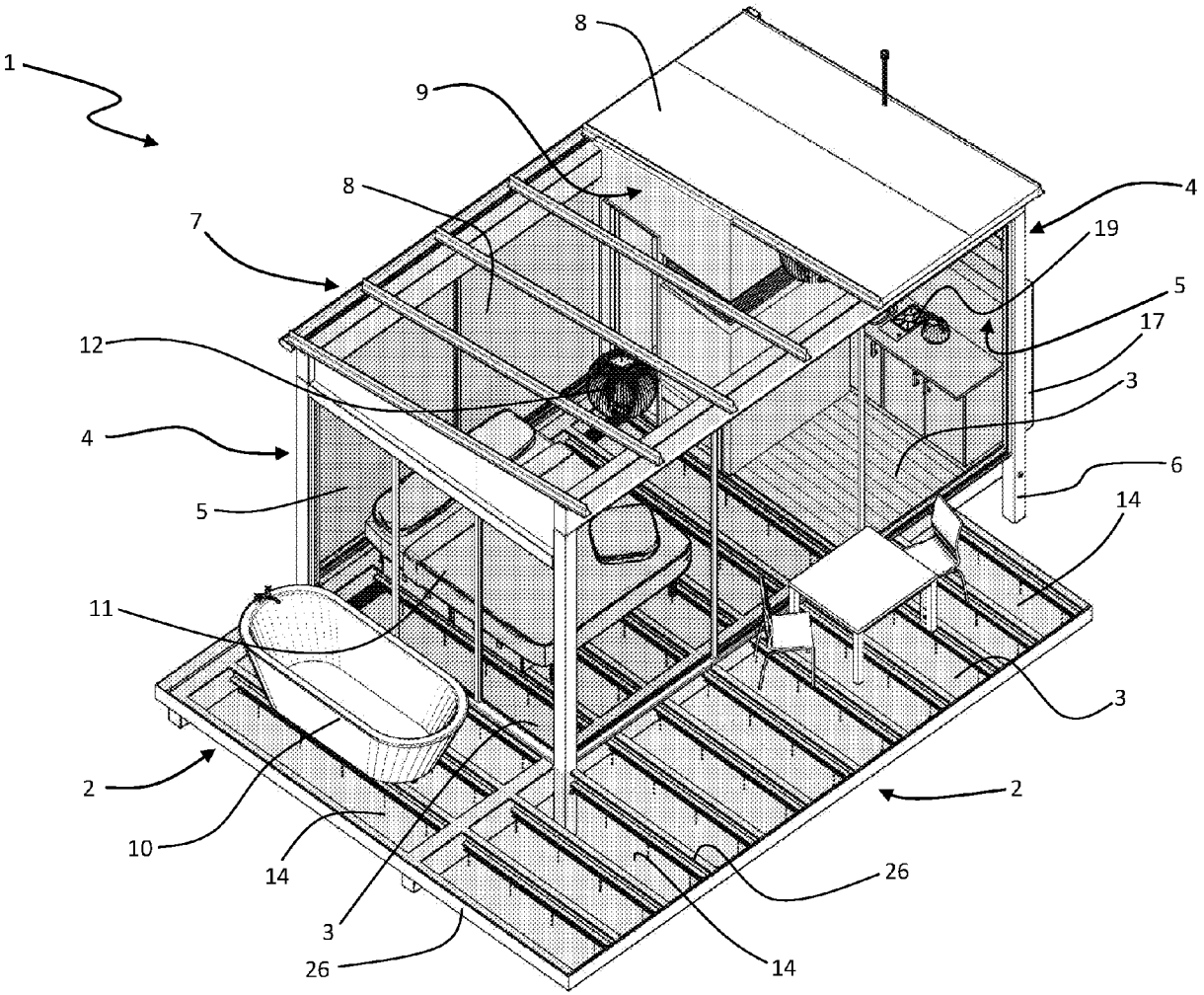
FIG. 1 shows a first preferred embodiment of the present invention in the form of a dwelling shown from a first front perspective.
Figure 2:
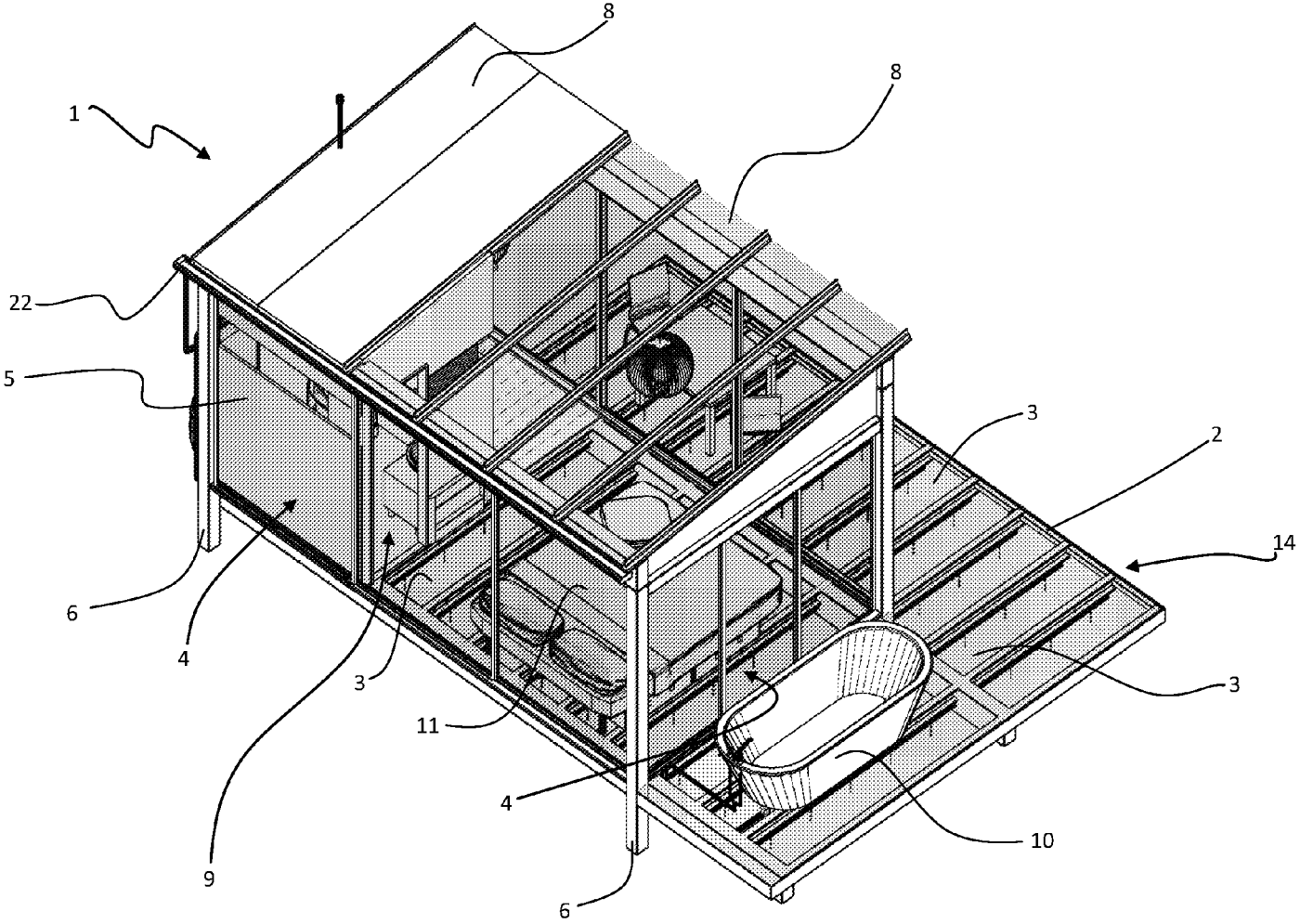
FIG. 2 shows the dwelling of FIG. 1, shown from a first rear perspective.
Figure 3:
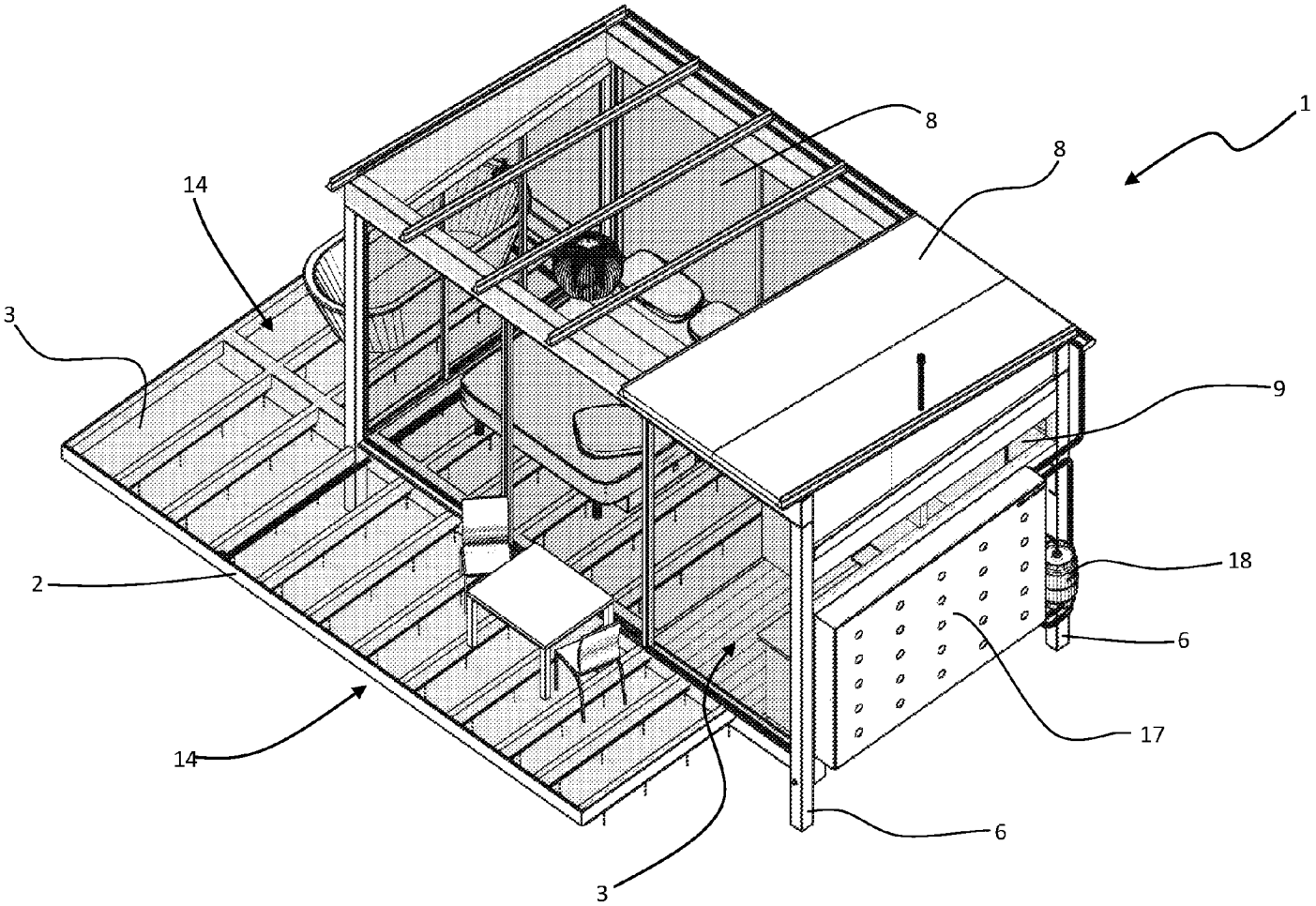
FIG. 3 shows the dwelling of FIG. 1, shown from a second rear perspective.
Figure 4:
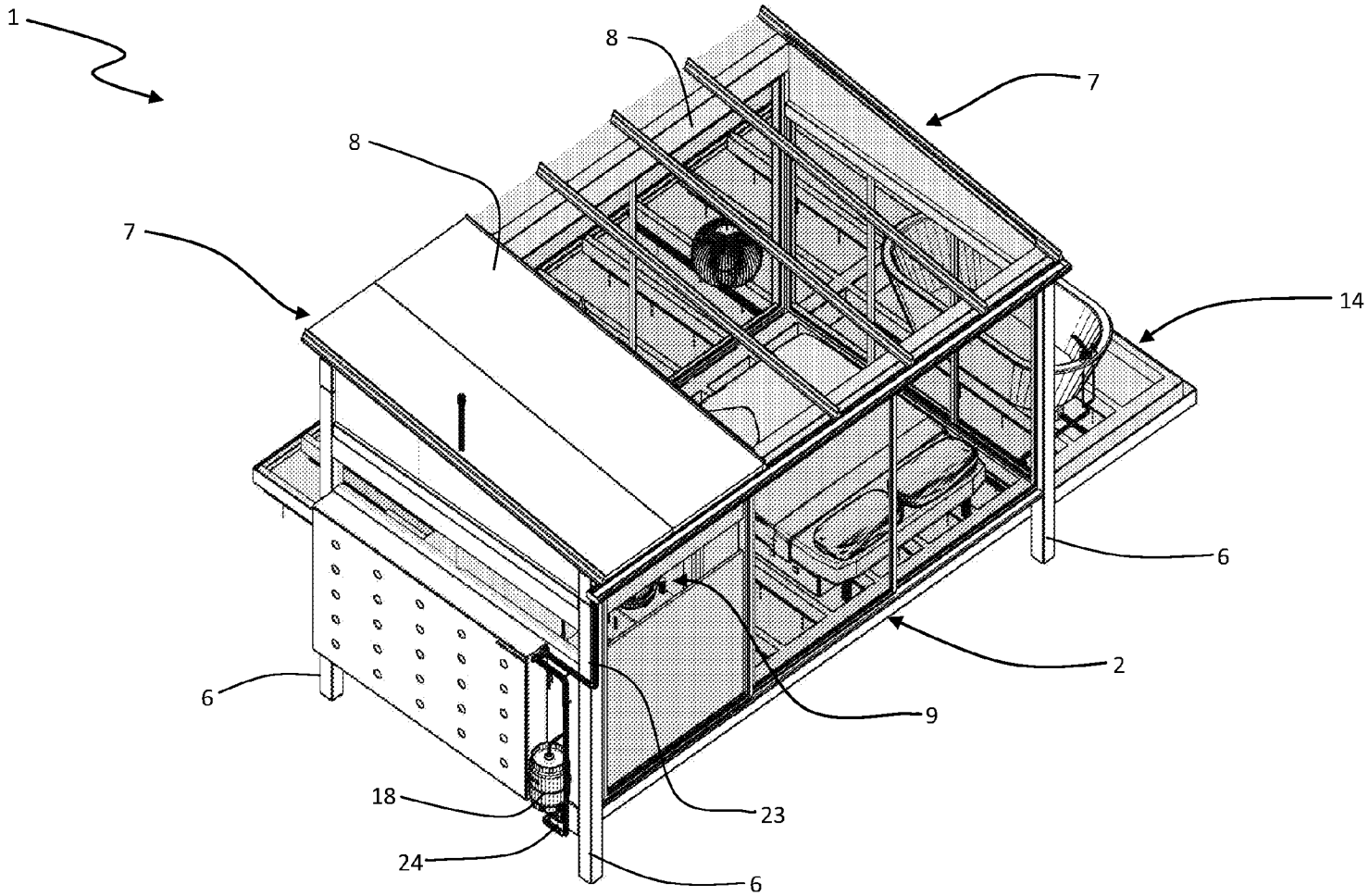
FIG. 4 shows the dwelling of FIG. 1, shown from a second rear perspective.

Reference numerals for FIGS. 1-11.

| | |
|---|---|
| (1) | dwelling |
| (2) | floor |
| (3) | floor section |
| (4) | wall |
| (5) | wall section |
| (6) | floor section support |
| (7) | roof |
| (8) | roof section |
| (9) | bathroom |
| (10) | outside bath |
| (11) | double bed |
| (12) | indoor lighting |
| (13) | stove |
| (14) | deck |
| (15) | terrain surface |
| (16) | terrain mount |
| (17) | water detention tank |
| (18) | gas storage bottle |
| (19) | gas cooker |
| (20) | sunlight |
| (21) | rain water |
| (22) | roof gutter |
| (23) | downpipe |
| (24) | irrigation distribution system |
| (25) | irrigation tubing |
| (26) | joists |
| (27) | floor gutter |
| (28) | common service wall |
| (29) | sliding divider |
| (30) | suspension element |
| (31) | anchor point |
| (32) | support pole |
| (33) | tree |
| (34) | water feature |
| (35) | solar panel |
| (36) | heater |
| (37) | flue |
| (38) | partition wall |
| (39) | toilet |
| (40) | shower cubical |
| (41) | wall/door |
| (100) | dwelling |

FIGS. 1-9 show a first embodiment of the present invention of a structure in the form of a recreational dwelling (1) configured to provide at least partial atmospheric transparency, and including:

- a floor (2), comprised of a plurality of individual floor sections (3);
- four walls (4), comprised of a plurality of individual wall sections (5),
- a dwelling support in the form of four floor section supports (6),
- a roof (7) including a plurality of individual roof sections (8)

The dwelling (1) shown in FIGS. 1-9 is shown by way of illustration only and the invention is not necessarily limited to same. Although configured as a minimalistic cabin for a couple, many alternative configurations may be utilised within the scope of the present invention. Intended as relatively short-stay holiday usage accommodation for individuals who wish to be highly immersed in their environment, the dwelling (1) is specifically intended to be sited in areas of high natural beauty, preferably private and isolated at least by line of sight from any other human habitations of activities.

The dwelling (1) includes a bathroom (9), an outside bath (10), a double bed (11), indoor pendant lighting (12) and a small stove (13).

The dwelling walls (4) define a substantially cuboid volume with a mono-pitch roof (7) with a deck (14) area projecting along one of the long and short sides. The roof (7) slopes upwards from a lower edge at the rearward edge along the long side of the cuboid towards the deck area (14) on the opposing side.

The wall sections (5) facing the deck area (14) are formed from sliding glass doors (either stacking or bi-fold) allowing the interior of the dwelling (1) to be almost completely opened to the environment.

Figure 5:
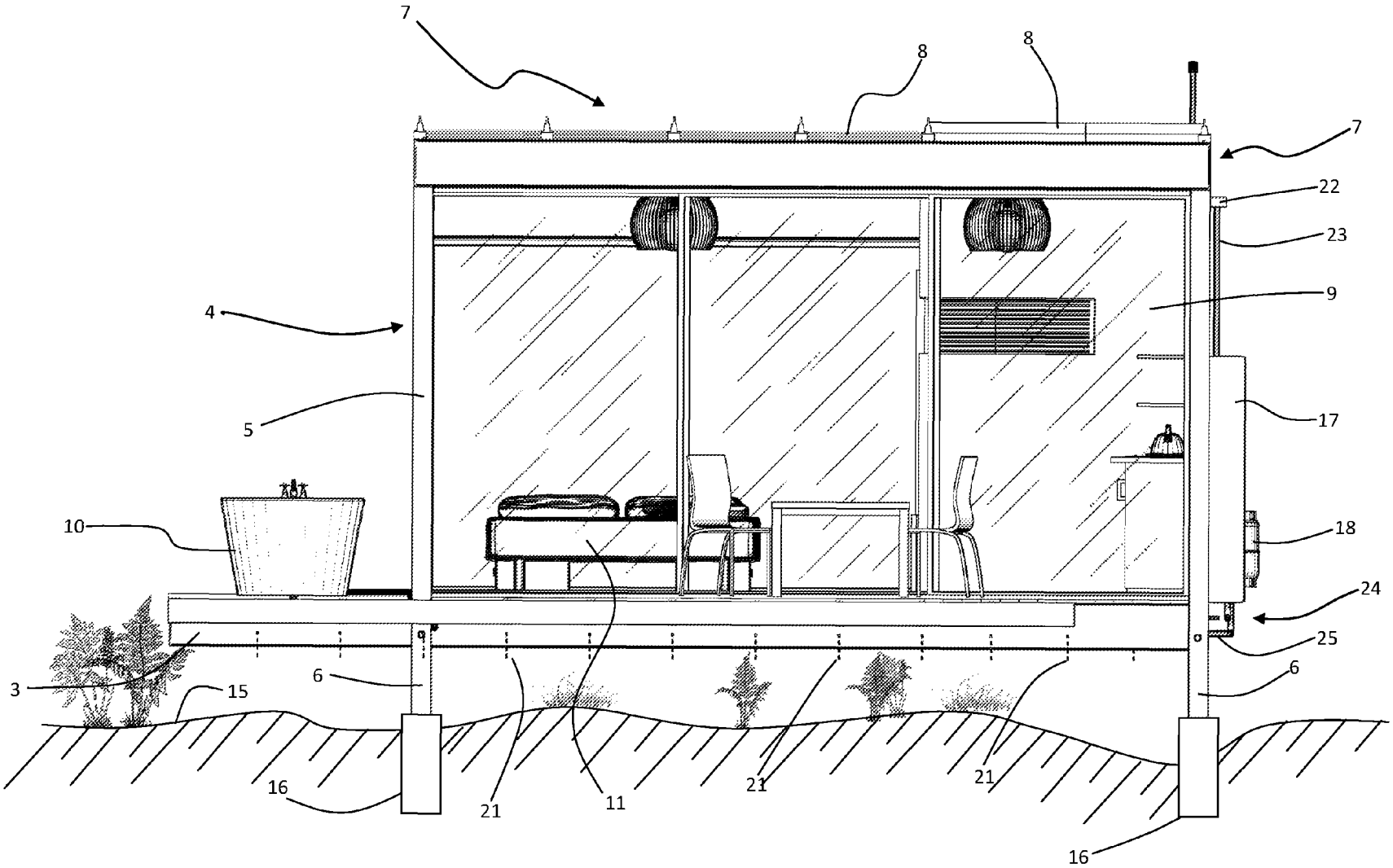
FIG. 5 shows a front elevation of the dwelling of FIG. 1.
Figure 6:
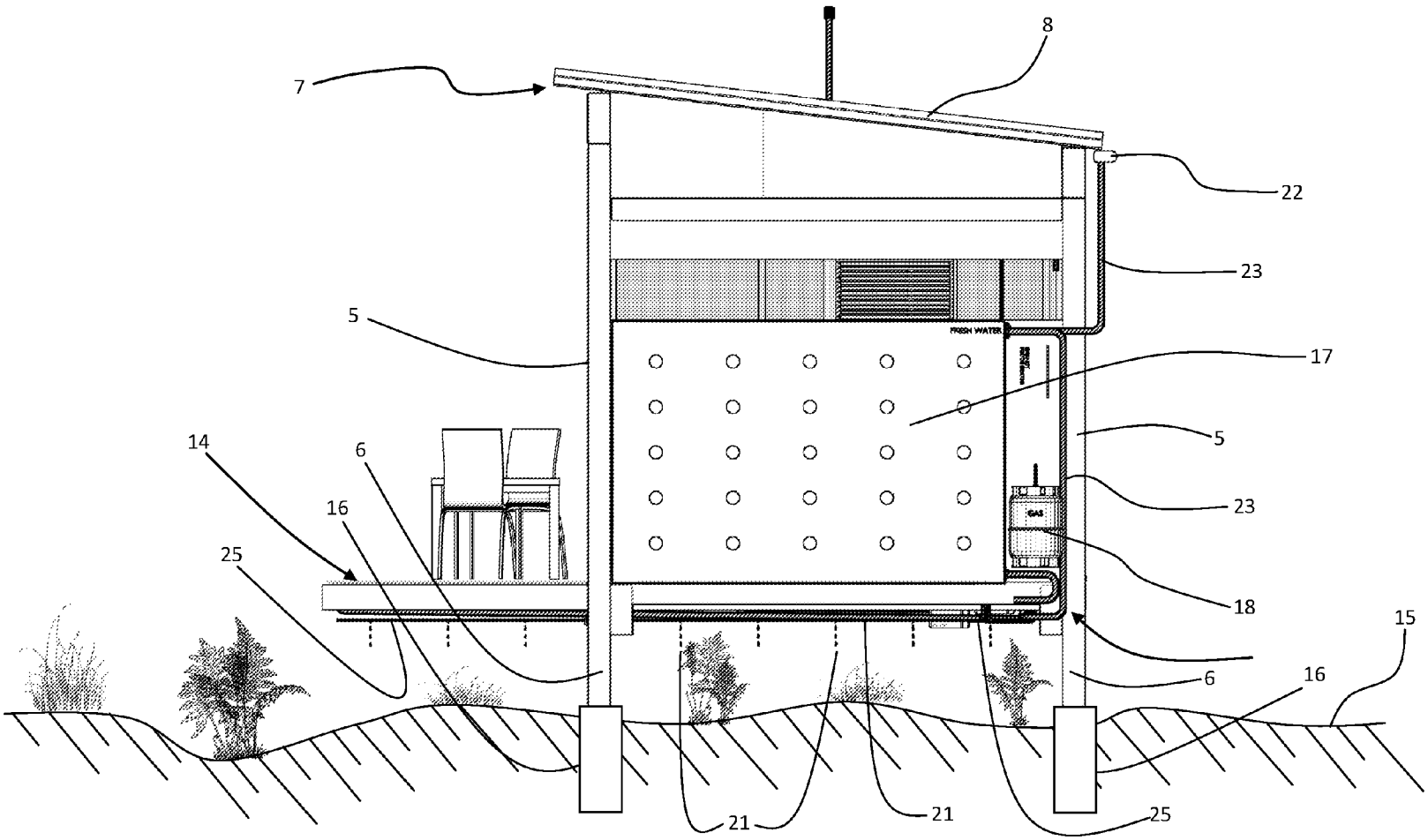
FIG. 6 shows a first side elevation of the dwelling of FIG. 1.
Figure 7:
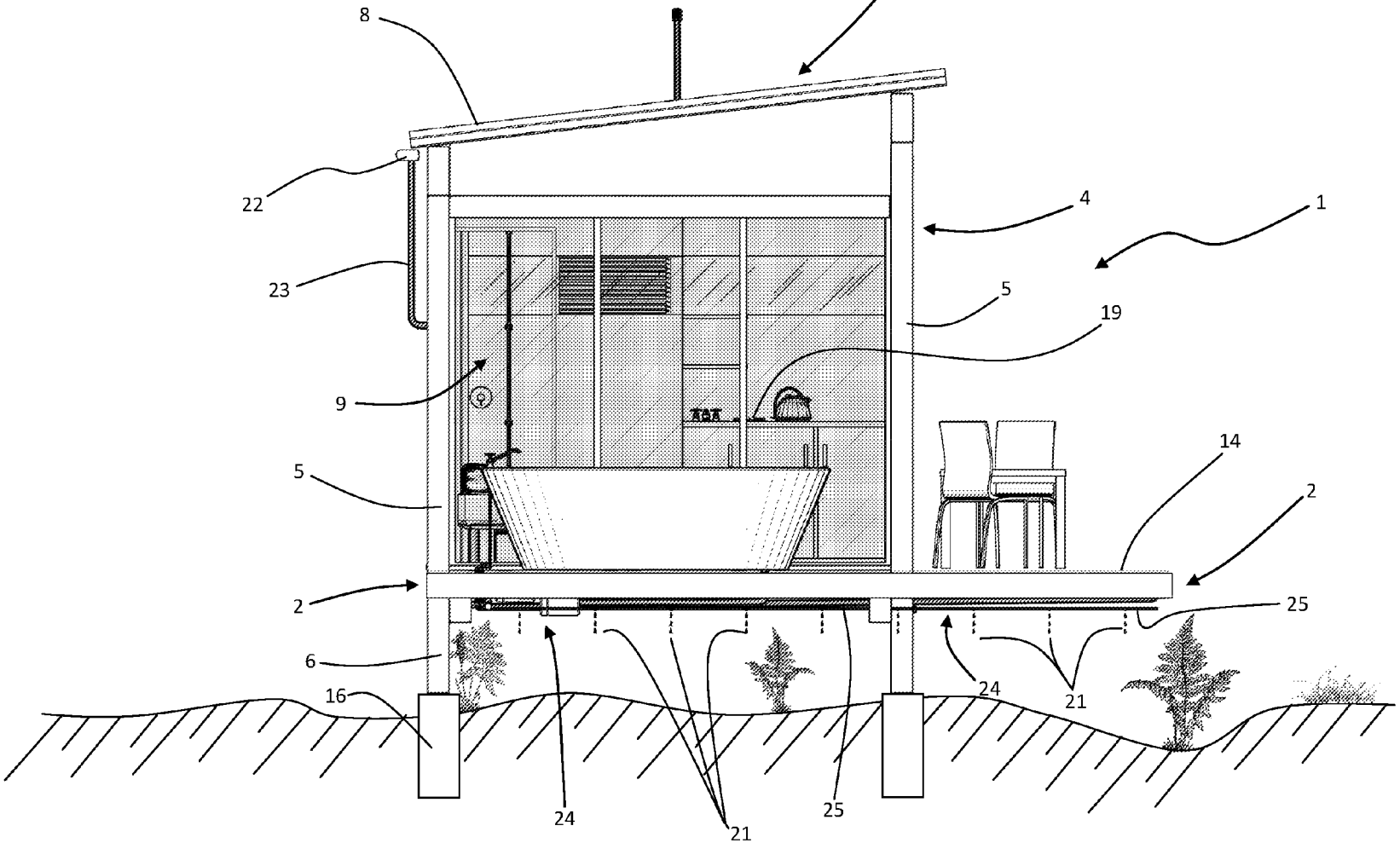
FIG. 7 shows a second side elevation of the dwelling of FIG. 1.

Although in alternative embodiments (shown in FIGS. 12-13 and described further below) the dwelling (1) may be suspended above the terrain surface (15) by appropriate dwelling supports, the embodiment shown in FIGS. 1-9 is sited directly on the terrain surface by dwelling supports in the form of four floor section supports (6). The individual floor section support (6) attach to a corresponding terrain mount (16) which are inserted into the terrain surface (15). The terrain mounts (16) (shown in FIG. 5 only) may take any convenient form including micro piles, spikes or similar ground-piercing fittings. Whilst FIG. 5 shows the terrain mounts (16) as separate elements, bolted to the floor section supports (6), they may be formed together as integral elements.

The floor (2), walls (4), and roof (7) are constructed from a steel framework predominately forming rectangular sections (forming the floor section, wall sections and roof sections (3, 5, 8) respectively) which are clad, in-filled, or overlaid with a transparent or opaque panel according to their role and location.

According to the first preferred embodiment illustrated, all the floor sections (3) and roof sections (8) apart from those bounding the bathroom (9) are transparent glazed panels. The wall sections (5) forming the bathroom (9) are also opaque as well as the adjacent side wall (4) which contains the services for the dwelling (1) including:

- a water detention tank (17), and
- gas supply lines from an exterior gas storage bottle (18) to a gas cooker (19) and heater (not shown).

The remaining wall sections (5) are configured as glass sliding doors. Thus, when the weather permits, both the glass panels of the three non-opaque walls (4) may be retracted towards the opaque wall (4), completely opening the dwelling (1) up to the atmosphere. In one embodiment, the transparent roof sections (8) may be configured to also retract towards the bathroom (9) to provide further immersion with the environment.

A key feature of the dwelling is its ability to minimise the impact on the environment. Although constructed from durable materials, the dwelling (1) is configured to be effectively 'invisible' or 'transparent' from the perspective of the existing biota adjacent and underneath the dwelling (1). The terrain surface (15) under the dwelling (1) is able to receive substantially the same light and atmospheric moisture as it would have received without the presence of the dwelling (1). This atmospheric transparency is achieved by a number of techniques.

In any environment, the salient atmospheric elements affecting the biota are the wind, light and moisture incident on the terrain surface.

As the dwelling (1) is elevated above the terrain surface (15) solely by the four elongate floor section supports (6), wind is able to pass freely under the elevated floor (2).

Figure 8:
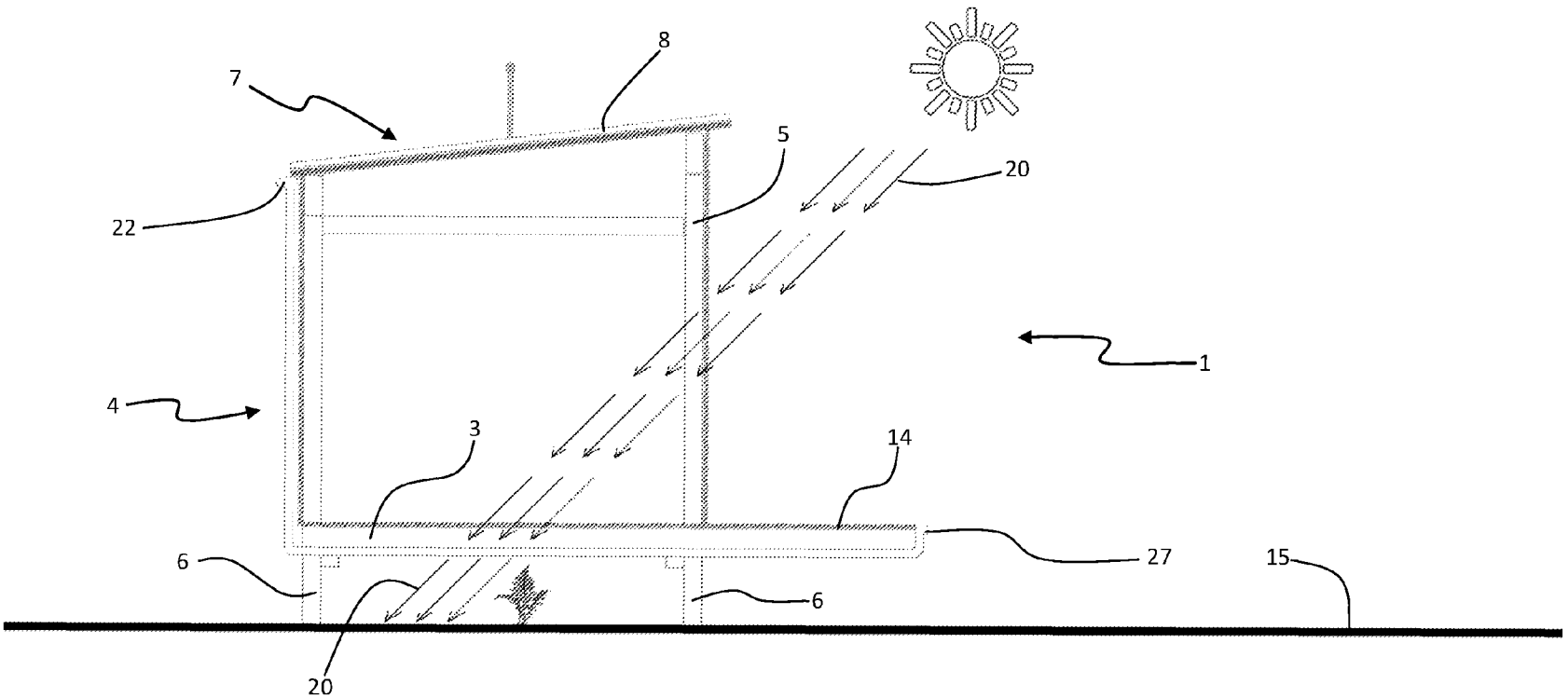
FIG. 8 shows a schematic side elevation of the interaction of light on the dwelling of FIG. 1.

Light incident on the dwelling is also able to reach the terrain surface (15) by virtue of the transparent wall sections (5) and the transparent floor sections (3). FIG. 8 illustrates schematically how sunlight (20) striking deck (14) directly is able to penetrate the transparent glass of the deck (14) and reach the terrain surface (15) below. Sunlight (20) striking the glass wall sections (5) passes in a direct line through into the dwelling interior before passing through the glass floor sections (3) until reaching the terrain surface (15) below. It will also be readily appreciated that even through the trajectory and solar elevation angle of the sun varies annually and throughout the day, light is still able to reach the terrain surface (15). Considering the situation at the extremities of the sun's elevation;

- at very shallow incident (low) angles, sunlight (20) will still pass through the dwelling (1) as described above and may also pass directly under the floor (7) to the terrain surface (15) without striking the dwelling (1);
- at high incident angles, sunlight (20) may strike, and pass through, the transparent roof sections (8) before passing through either a transparent floor section (3) or a wall section (5) and then reaching the terrain surface (15).

The flora in the potential shadow of the dwelling (1) is thus actually still illuminated with light and able to photosynthesise.

Figure 9A:
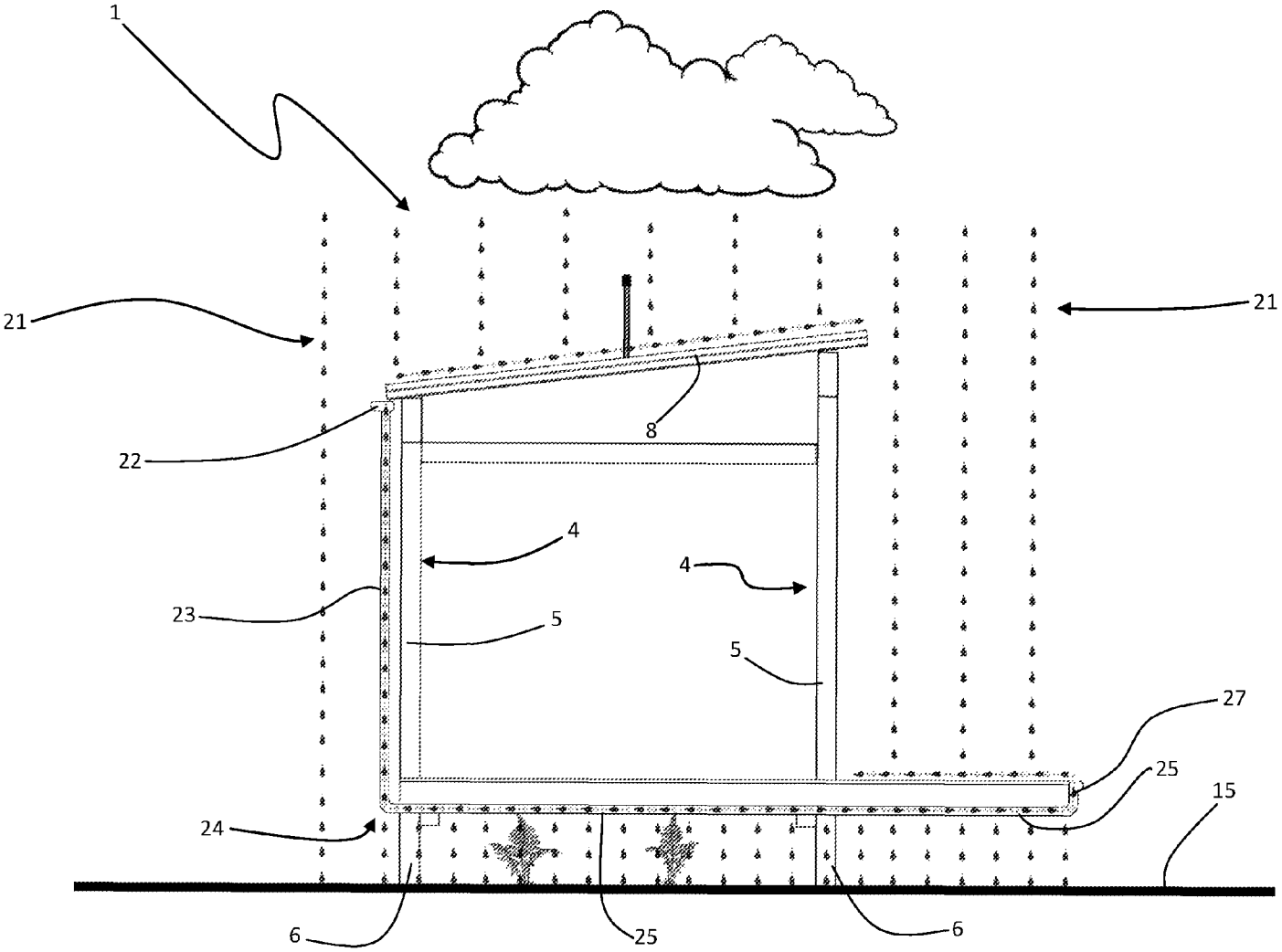
FIG. 9*a* shows a schematic side elevation of the interaction of rain water on the dwelling of FIG. 1.
Figure 9B:
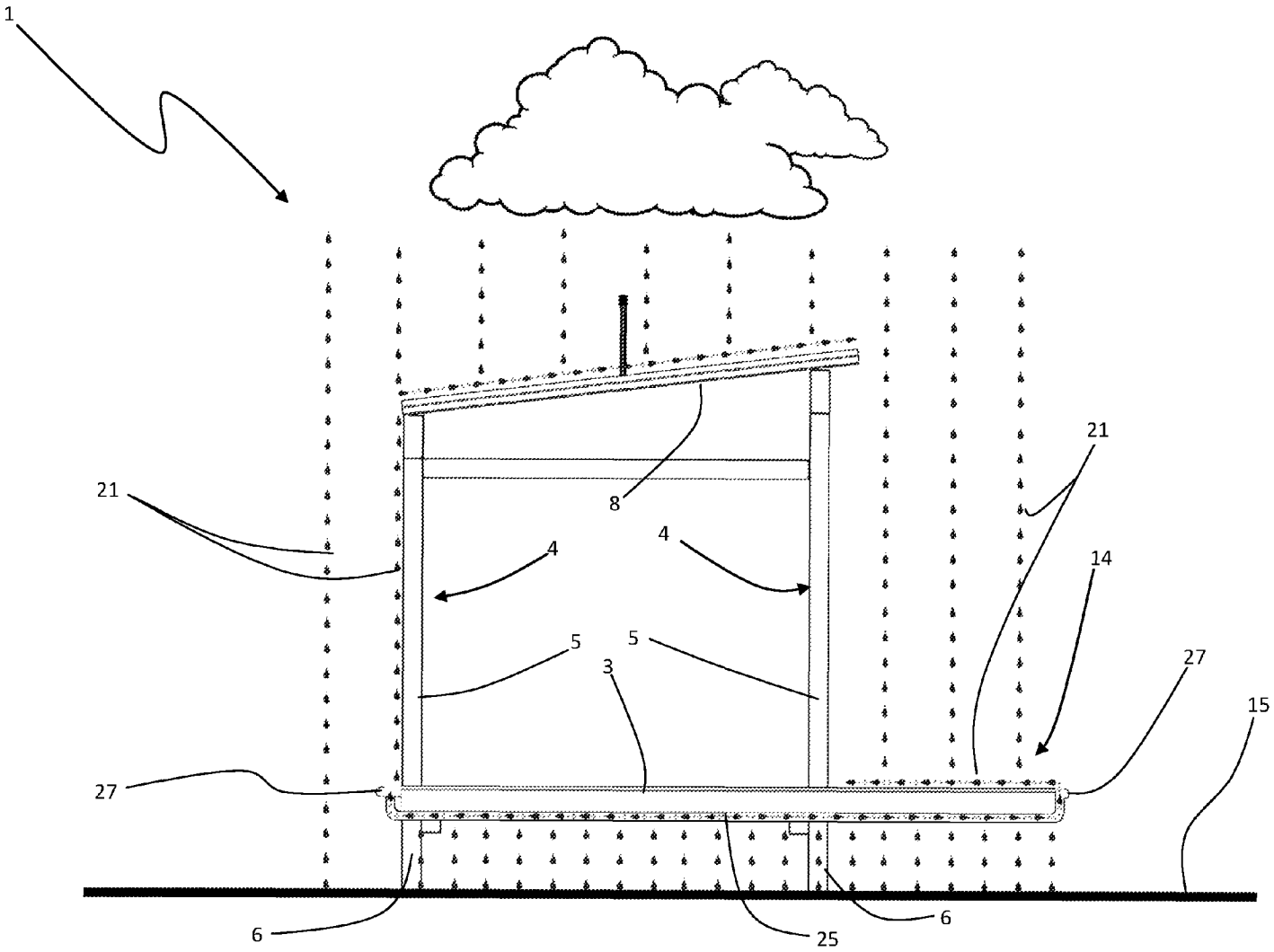
FIG. 9*b* shows a schematic side elevation of the interaction of rain water on a dwelling according to a further preferred embodiment of the present invention.

The interaction of airborne moisture in the form of rain (coming into contact with the dwelling (1) is shown schematically in FIGS. 9*a* and 9*b*. In the embodiment shown in FIG. 9*a*, rain (21) falling on the roof (7) runs downwards and falls from the lower roof perimeter into a roof gutter (22) positioned at the top of the adjacent wall (4). The rain water (21) then flows through a downpipe (23) down the outside of the wall (4) until reaching an irrigation distribution system (24) located below the level of floor (2). The irrigation distribution system (24) is a network of irrigation tubing (25) attached to a plurality of joists (26) spanning the underside of the floor (2).

In embodiments such as that shown in FIGS. 1-9*a*, where the deck (14) surface formed from transparent floor sections (3) of solid panels of glass, the deck (14) surface is inclined slightly to allow the incident rain (21) to run off towards a floor gutter (27) at the edge of the deck (14) before feeding into the irrigation distribution system (23). Numerous alternative methods may be employed to re-distribute the rainwater (from the upper surfaces of the dwelling to the terrain surface (15) under the dwelling (1). In the alternative embodiment shown in FIG. 9*b*, the roof gutter (22) is replaced with a further floor gutter (27) positioned at the bottom of the wall section (5) beneath the low-side of the roof (7), allowing the occupants to watch rainwater passing down the walls (4) and/or the deck (14) before being redistributed to the terrain surface (15) by the irrigation distribution system (23).

While FIG. 9 shows a simplified diagrammatic representation of the rainwater flow (21), FIGS. 1-7 show the incorporation of the water detention tank (17) into the exterior of the opaque wall (4) adjacent the bathroom (9).

In order to provide the occupants with an environmentally friendly water supply for domestic use, the rain (21) collected from the roof gutter (22) is temporarily stored in a detention tank (17). When the detention tank (17) is filled to a predetermined level, any excess rain water (21) collected bypasses, or overspills from the tank (17) straight to the irrigation distribution system (24).

Water consumption by the occupants is then replenished by subsequent rainfalls. The detention tank (17) refills to said predetermined level before being diverted to the irrigation distribution system (24). It will be appreciated that some dwellings (1) may, according to the occupants water requirements and the frequency and volume of rain fall, incorporate a separate or supplementary water supply and storage system to the rain-filled detention tank (17).

The present invention thus substantially provides a dwelling (1) with effective atmospheric transparency to the elements of wind, light (20) and moisture (21).

It is possible to allow the terrain surface (15) beneath a building to receive all these atmospheric elements without interference by simply raising a conventional dwelling sufficiently high above the terrain surface (15). However, raising the dwelling height excessively poses significant drawbacks, namely;

- the difficulty and inconvenience in access to and from a dwelling that is high above the terrain surface;
- minimizing the feeling of immersion in, and connection between, the occupants and their environment which is replaced instead with an artificial or surreal 'bird's eye' viewpoint, and
- the risk of injury from a fall, and/or the hindrance (both visually and physically) of safety barriers, guards rails and the like to the user's experience of the surrounding environment.

However, to bring a dwelling to within a sufficient height from the terrain surface to overcome these drawbacks would adversely affect the biota under the dwelling without the atmospheric transparency of the present invention.

In the embodiment of the present invention shown in FIGS. 1-9, the floor/deck (2, 14) is elevated less than 1 m from the terrain surface, which complies with New Zealand building regulations for decks and walkways to avoid need for a railing/barrier. The modular nature of the dwelling (1) not only simplifies construction of the sub-components such as the walls (4), floor (2), roof (7), deck (14) and bathroom (9), it facilitates design modification whereby individual floor/wall/roof sections (3, 5, 8) may be added/subtracted to alter shapes, sizes and ratios. On a larger scale, the entire dwelling (1) from the embodiment shown in FIGS. 1-9 may be combined together to create larger dwellings (100) as shown in FIGS. 10-11.

Figure 10:
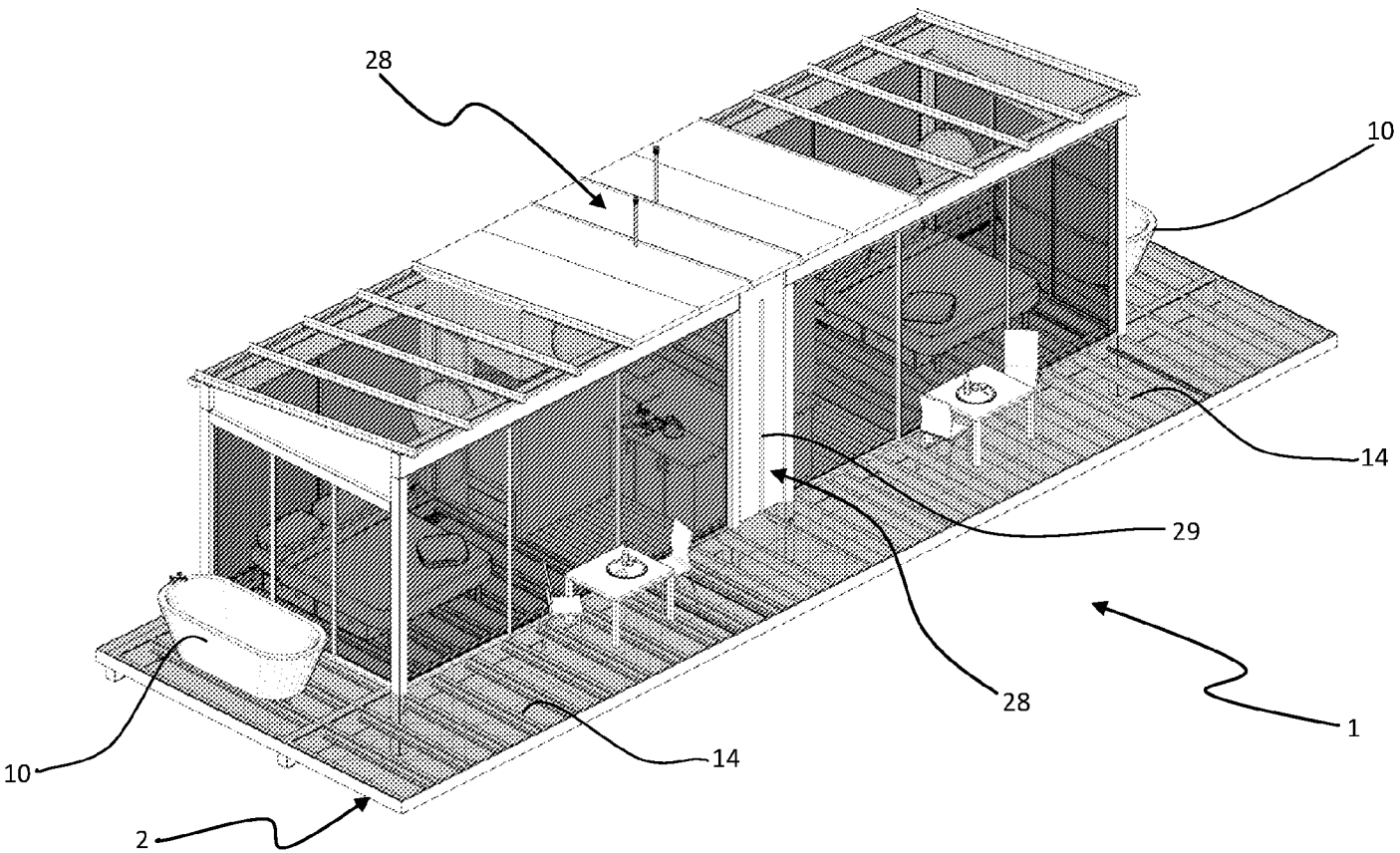
FIG. 10 shows a further preferred embodiment of the present invention in the form of a dwelling shown from a first front perspective.
Figure 11:
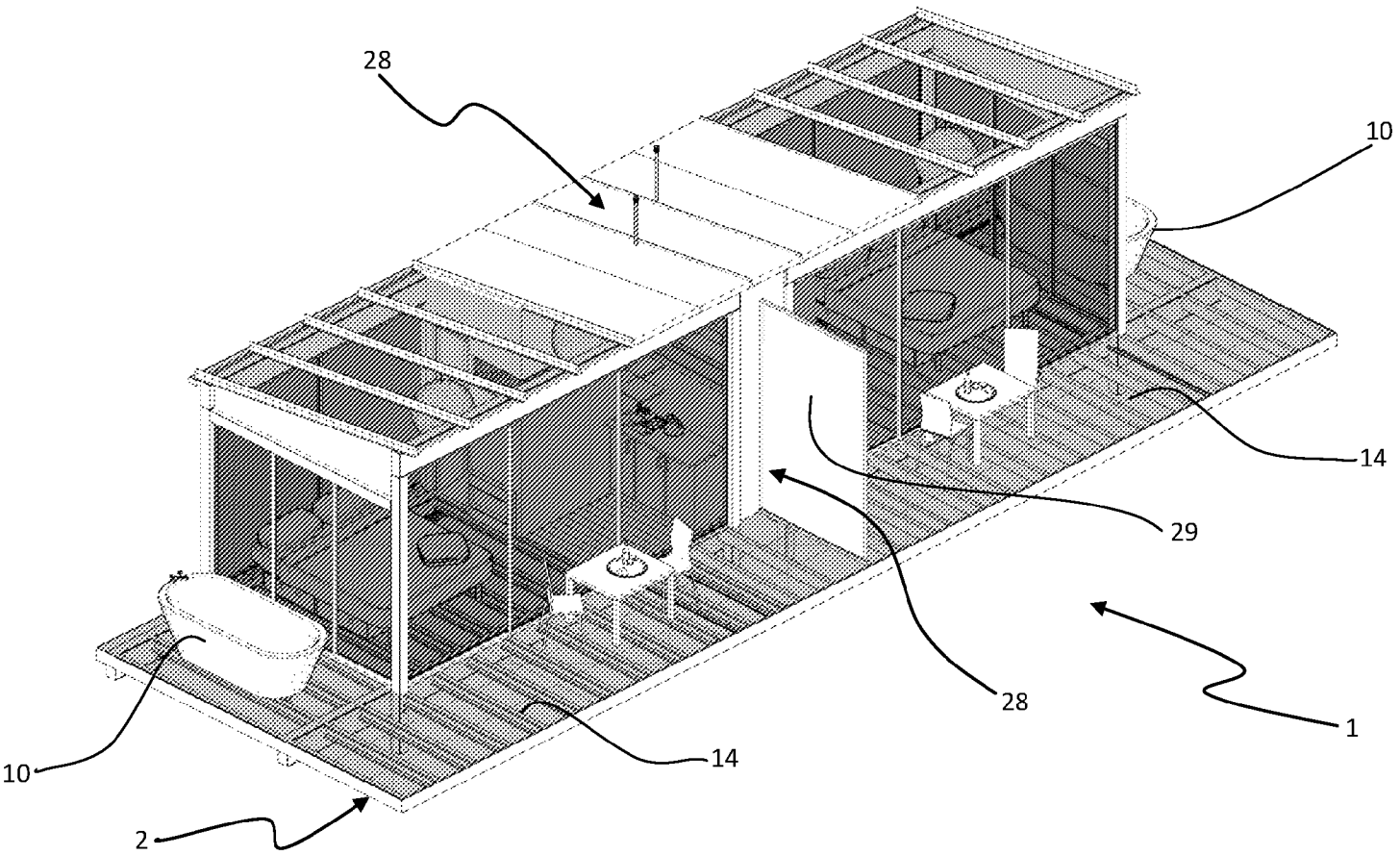
FIG. 11 shows the dwelling of FIG. 10, shown with a sliding divider in an extended position.

The dwelling (100) in FIGS. 10 and 11 essentially comprises two dwellings (1), joined together. One of the dwellings (1) is configured as a mirror image of the other to enable the two dwellings (1) to utilise an opaque service wall (28) to act as a common dividing wall. This enables, for example, a family with children, or two couples to share the same environment whilst still maintaining some privacy from each other. FIG. 11 shows an optional retractable sliding divider (29), in an extended position, subdividing the decks (14) on both halves of the dwelling (100).

Figure 12:
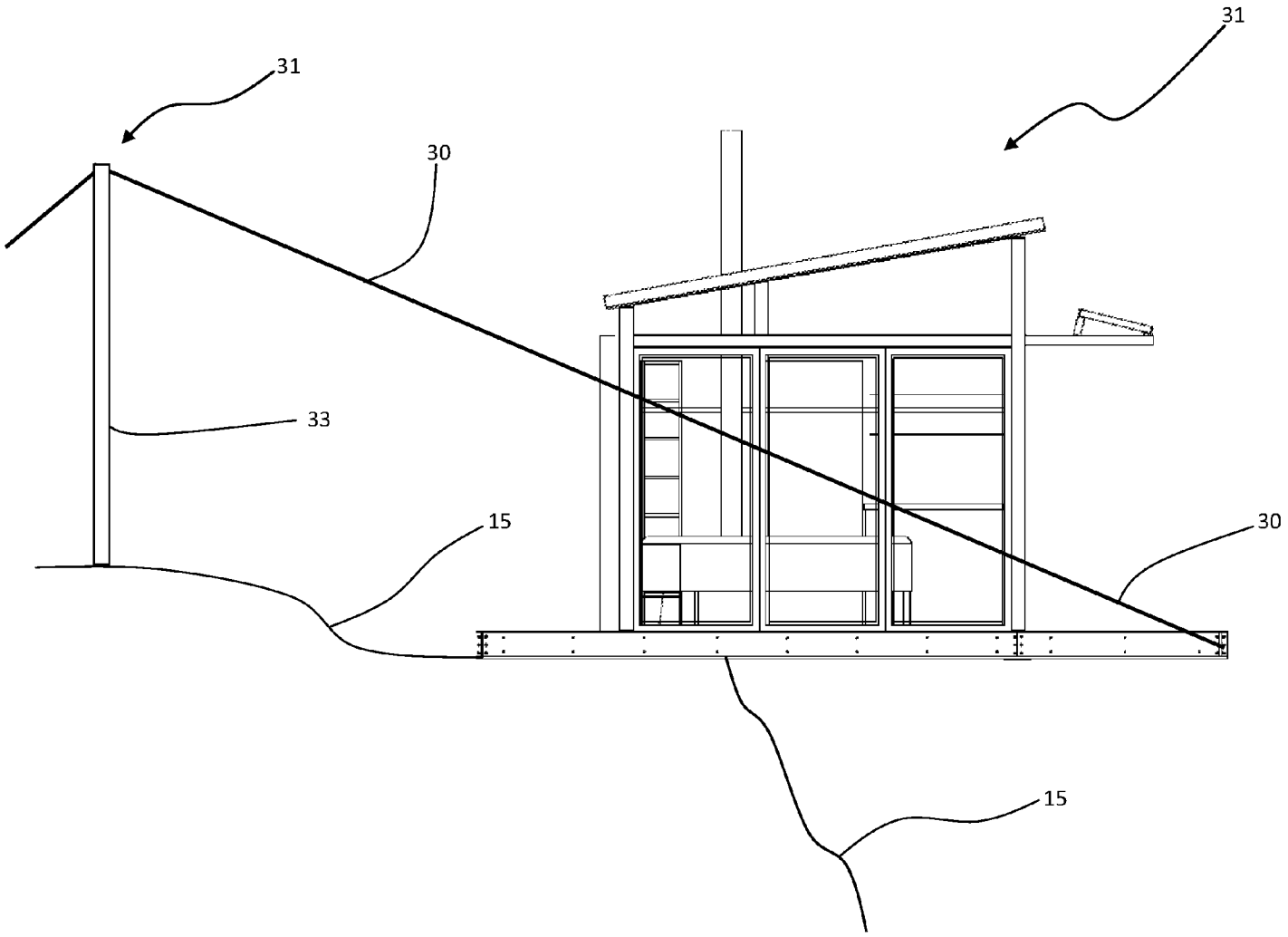
FIG. 12 shows a further preferred embodiment of the present invention in the form of a dwelling suspended over a precipice.
Figure 13:
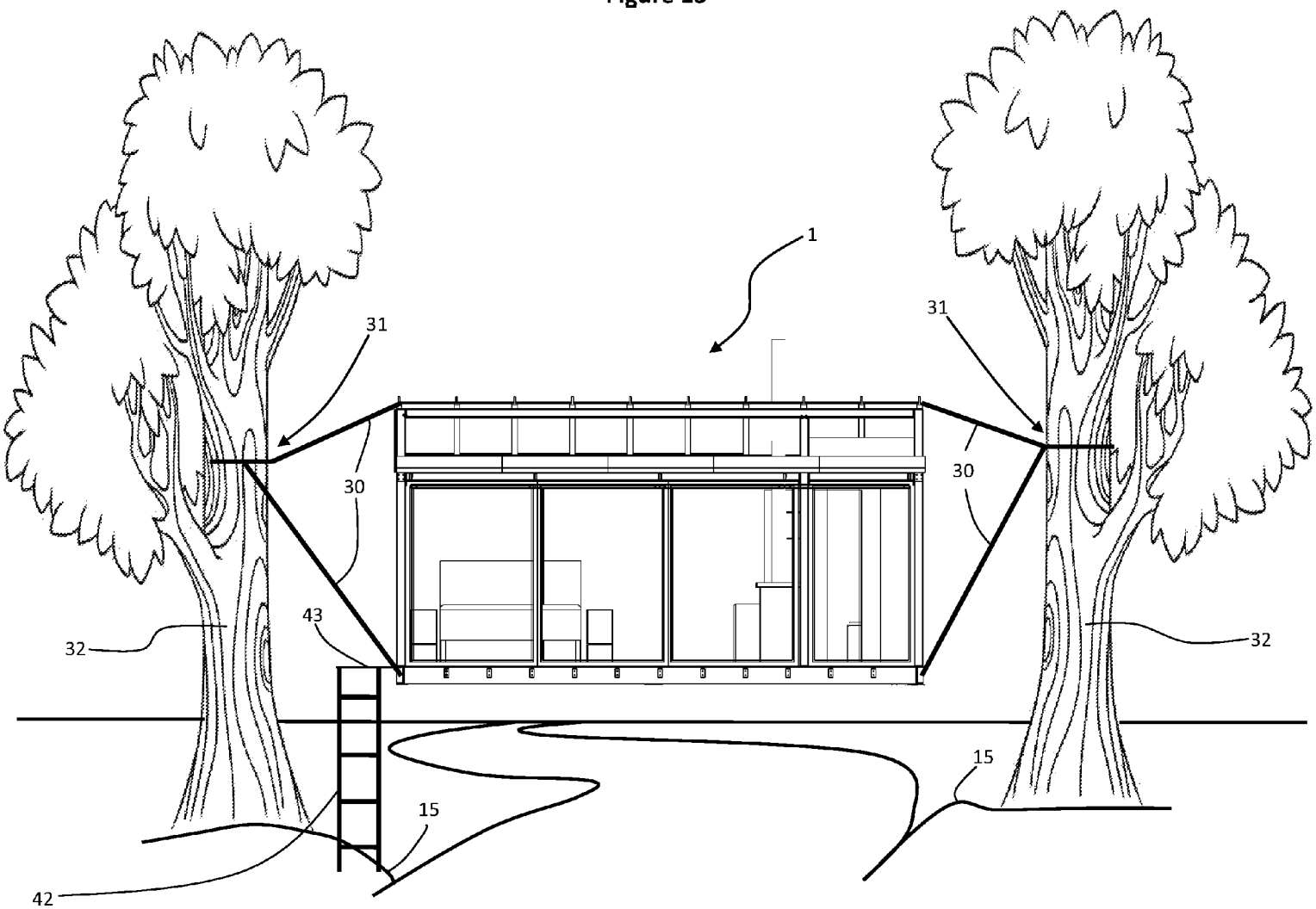
FIG. 13 shows a front elevation of the dwelling of FIG. 12 suspended between two trees over a river.

FIGS. 12 and 13 show a further embodiment of the dwelling (1), suspended above the terrain surface (15) by one of more suspension elements (30), attached to anchor points (31) affixed to the terrain surface (15). The anchor points (31) may be any appropriate natural features such as trees (32) (shown in FIG. 13), rock features or outcrops and/or purpose-made ground anchors, rock bolts, support poles (33) (as shown in FIG. 12) or the like. FIG. 12 shows the dwelling (1) located on a terrain surface (15) with a rearward portion of the dwelling (1) at the edge of a precipice, whilst the remainder of the dwelling (1) projects into free space, suspended by suspension elements (30). At one end, the suspension elements (30) are attached to an outer perimeter of the joists (26) at the apex of the deck (14), whilst the other end is shown attached to an anchor point (31) in the form of a support pole (33). The occupants of the dwelling (1) are thus able to see the view downwards through the transparent floor sections (3) as well as the wall sections (5) and roof sections (8).

FIG. 13 shows the dwelling (1) suspended between two anchor points (31) in the form of two trees (32) spanning a natural water feature (34), e.g. a river, stream, brook or the like. The dwelling (1) is suspended by suspension elements (30) attached at each apex of the floor (2) and roof (7). It will be readily understood however that numerous alternative means of suspension are possible as a matter of design choice. The dwelling (1) is accessed by a ladder (42) extending from the terrain surface (15) to a platform (43) extending from the deck (14).

Figure 14:
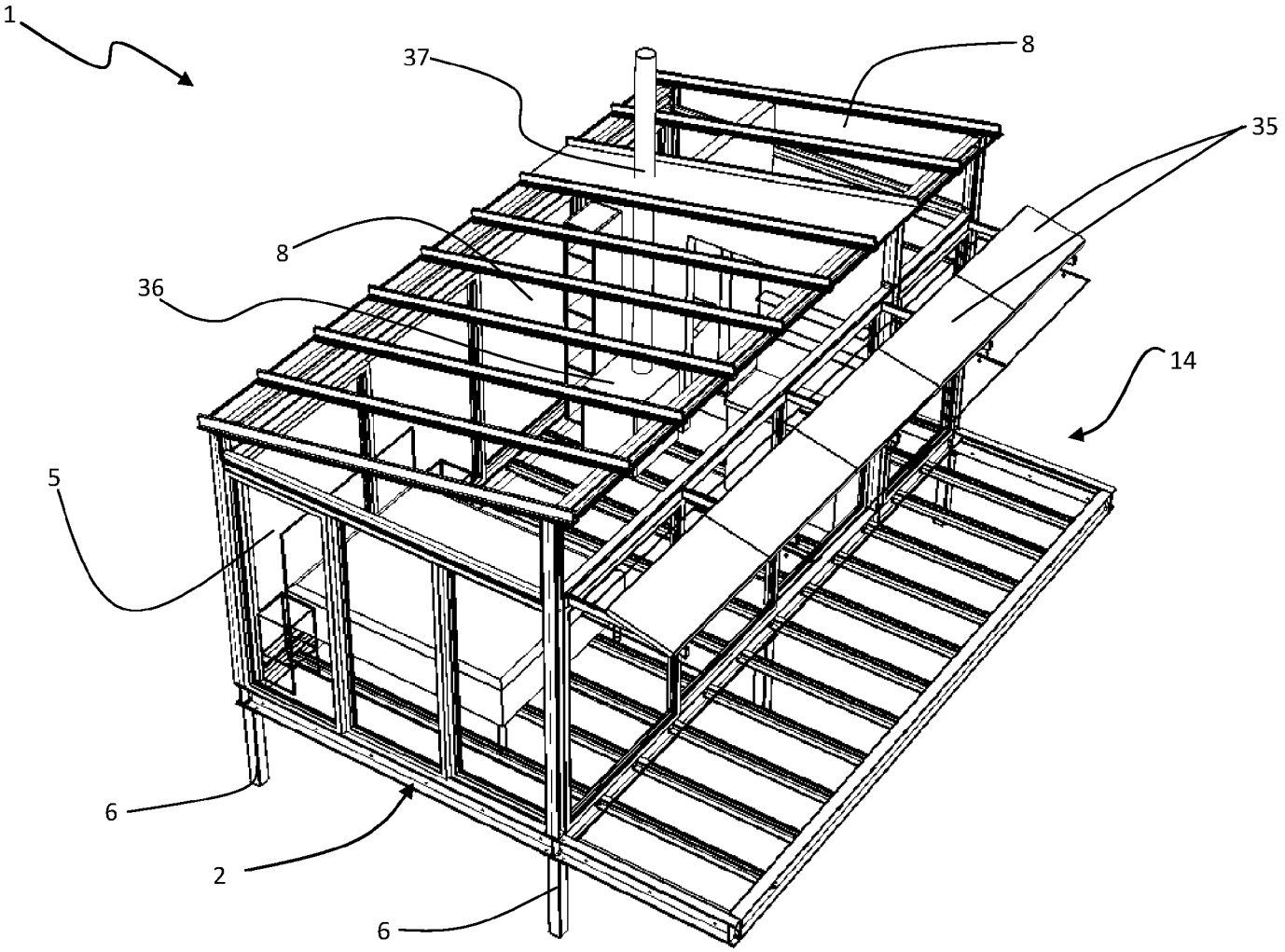
FIG. 14 shows a first front perspective of the dwelling of FIG. 12.
Figure 15:
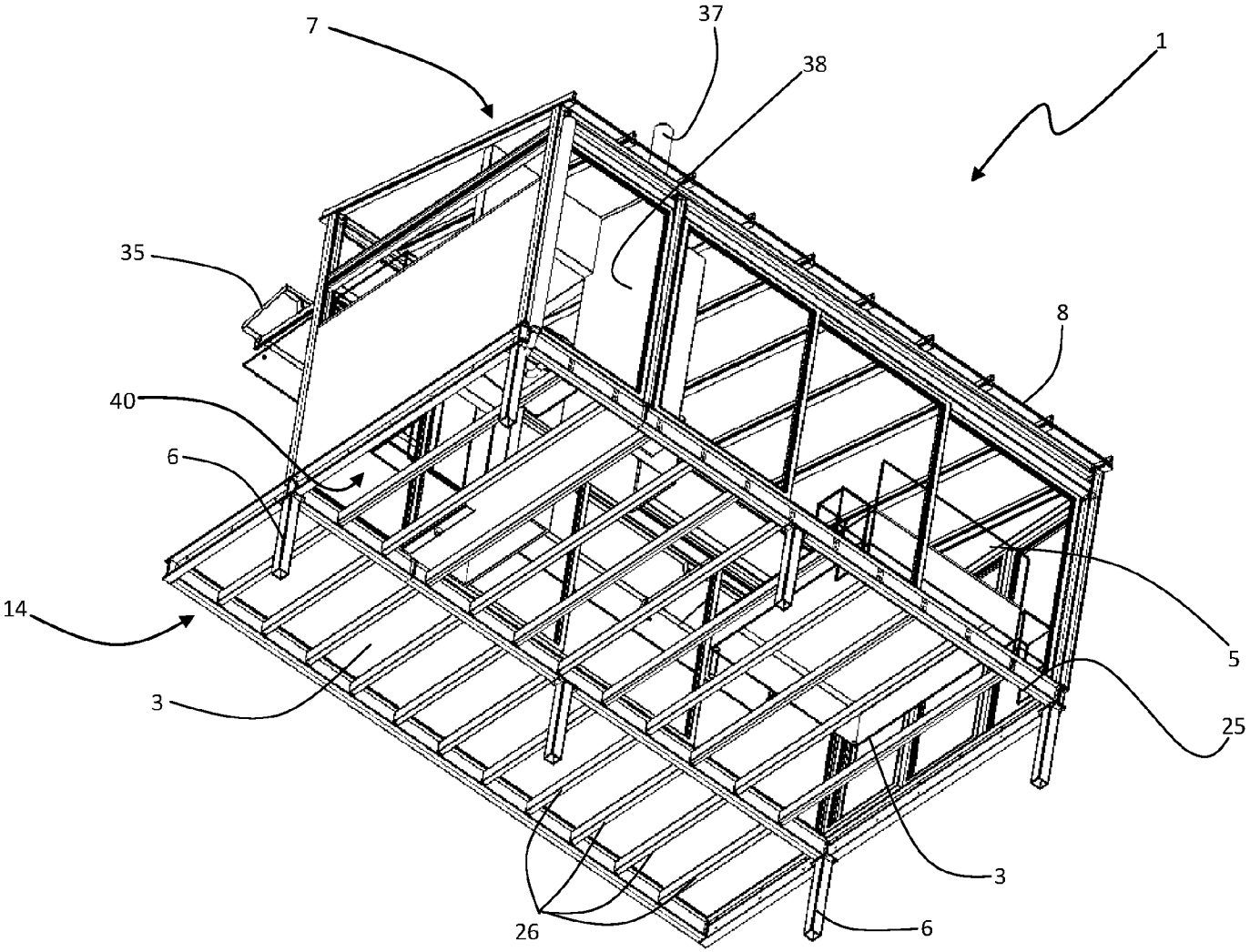
FIG. 15 shows a first lower rear perspective of the dwelling of FIG. 12.
Figure 16:
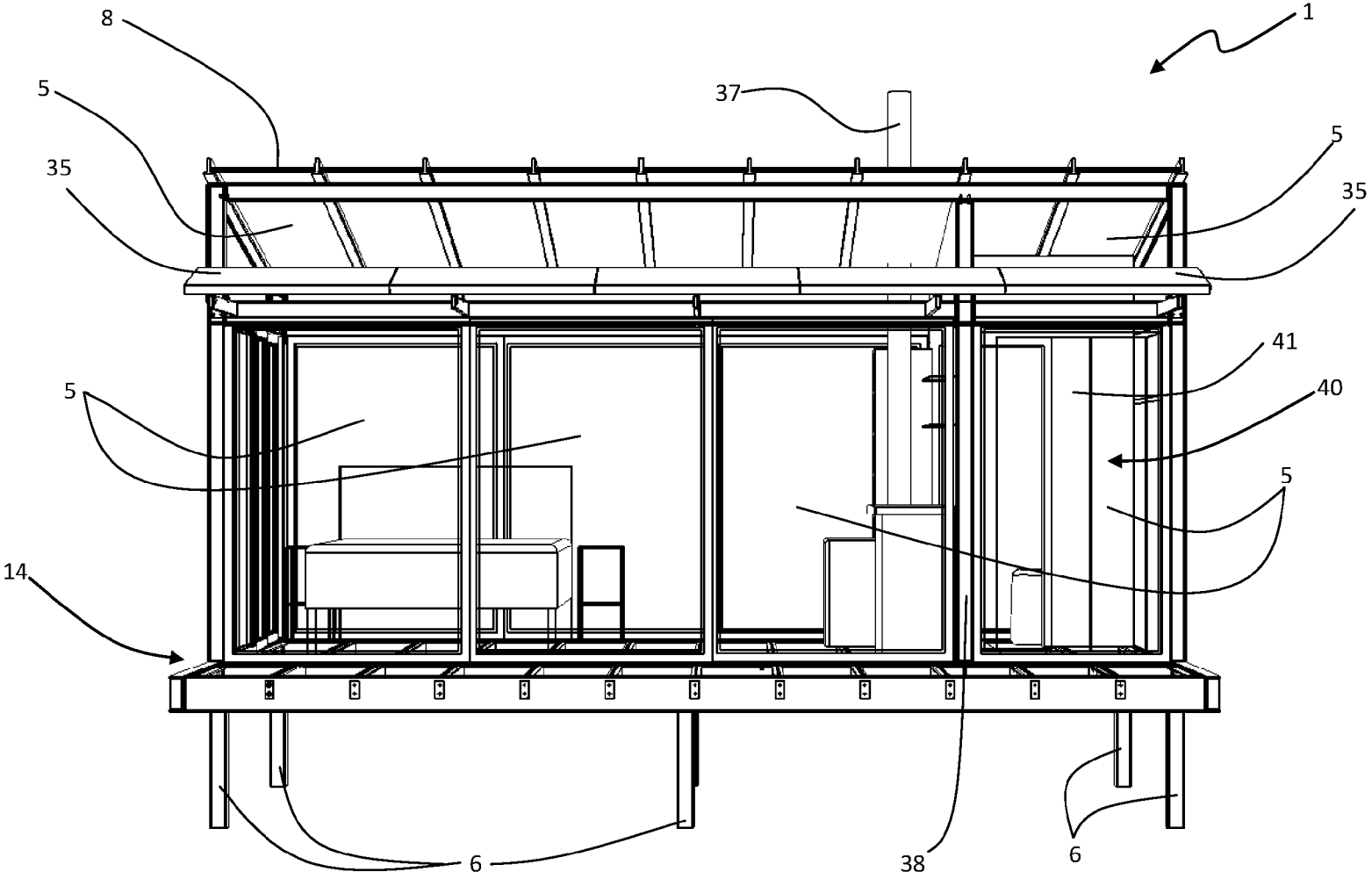
FIG. 16 shows a second front elevation of the dwelling of FIG. 12.
Figure 17:
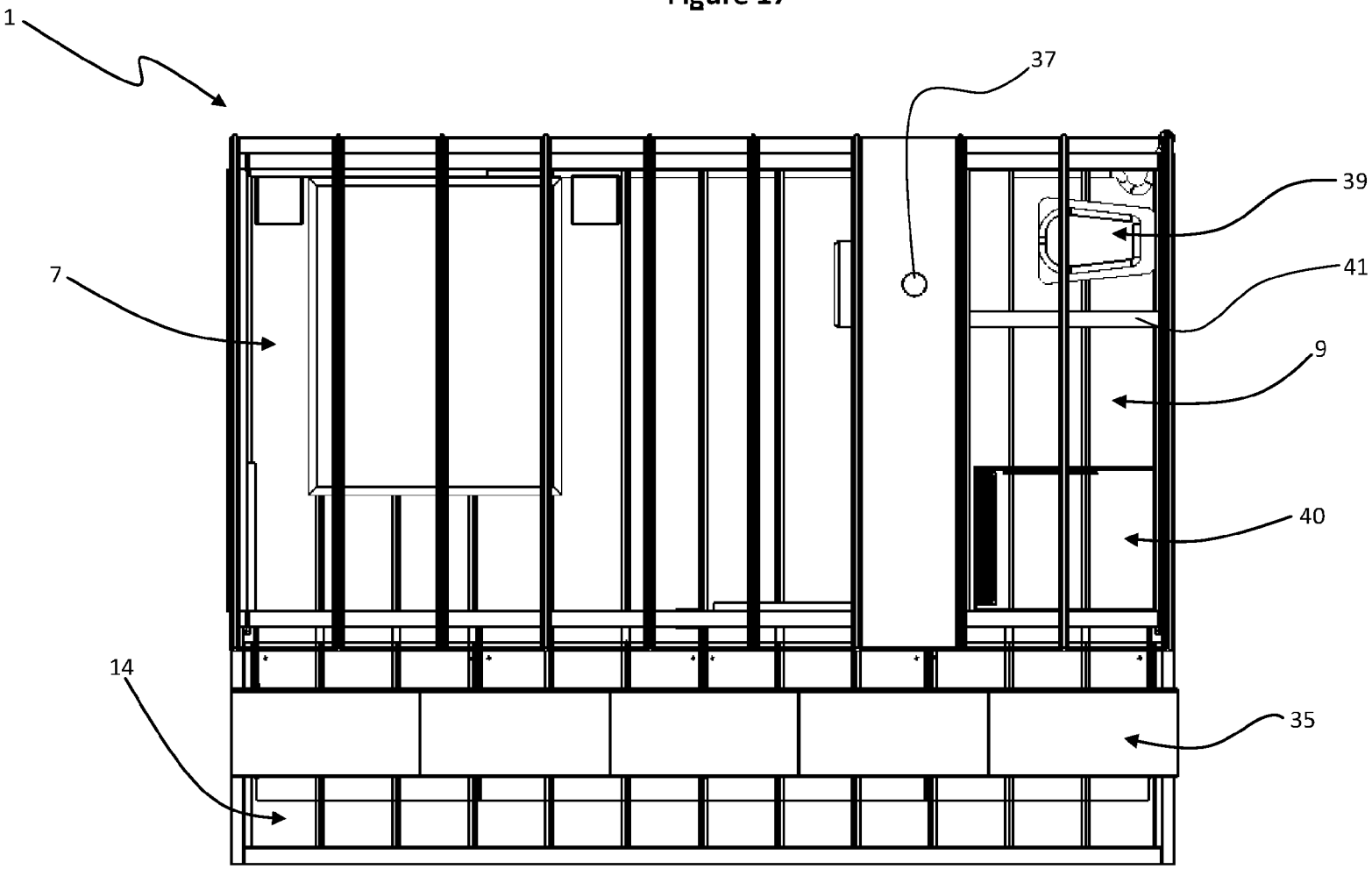
FIG. 17 shows a first plan view of the dwelling of FIG. 12.

FIGS. 14-16 show greater detail of the embodiment of FIGS. 12 and 13 in the form of a dwelling (1) substantially similar to the embodiment of FIGS. 1-9. The embodiment shown differs in layout configuration, whereby the side deck (14) and external bath (10) have been omitted and the floor space of internal living area correspondingly increased. A series of solar panels (35) are mounted above the wall (4) adjacent the deck (14). The solar panels (35) provide not only electrical power, but a degree of sun shading without obscuring the view. A heater (36) of some appropriate configuration and output (e.g. wood burner, gas, multi-fuel, bio-ethanol or the like) provides warmth during inclement weather and vents through a roof flue (37).

The bathroom (9) is separated from the living/sleep area by a transverse partition wall (38). The bathroom (9) contains a toilet (39) and shower cubical (40) mutually separate by an inner bathroom wall and door (41). The shower cubical (40) is constructed with a transparent floor (3) and (optionally) with at least one transparent wall section (5).

Forming the shower cubical (40) floor and wall sections from a solid transparent material such as glass advantageously provides a waterproof surface suitable for wet-room use without further treatment or additional layers/structures.

Similarly, the toilet (39) may be formed with a transparent floor section (3), while the wall sections (5) may be transparent or opaque according to user/owner preference.

Aspects of the present invention have been described by way of example only and it should be appreciated that modifications and additions may be made thereto without departing from the scope thereof.

The invention claimed is:

1. A terrestrial dwelling including:

- a floor including at least one floor section, oriented substantially horizontally in use;
- at least one wall including at least one wall section, projecting substantially upwardly from said floor section;
- a dwelling support, to at least partially elevate the floor section above a terrain surface;
- a roof with at least one roof section attached to an upper portion of said wall;
- an irrigation distribution system;

wherein;

said dwelling provides at least partial atmospheric transparency for atmospheric elements including light, rain and any other forms of airborne moisture incident on the dwelling above the floor to reach the terrain surface under the dwelling, the at least one floor section, the at least one wall section and the at least one roof section being transparent, the transparent floor section and transparent roof section being mutually positioned for light incident on the transparent roof section to reach the terrain surface under the floor by passing through said transparent floor section, said rain and moisture incident on said dwelling is diverted under the floor via at least one of:

said roof and said at least one wall, and re-dispersed onto the terrain surface below by said irrigation distribution system attached to an underside of said floor.

2. The dwelling as claimed in claim 1, wherein said dwelling support includes at least one floor section support.

3. The dwelling as claimed in claim 1, wherein the dwelling support includes at least one suspension element.

4. The dwelling as claimed in claim 1, wherein said dwelling is at least partially atmospherically transparent to wind.

5. The dwelling as claimed in claim 1, wherein the at least one transparent floor section and the at least one transparent wall section are mutually positioned for light incident on the transparent wall section to reach the terrain surface under the floor by passing through said transparent floor section.

6. The dwelling as claimed in claim 1, wherein the rain and moisture incident on at least one of the:

at least one roof section;

at least one wall section;

uncovered floor section forming a walkway or deck area exterior to the at least one wall section, is directly diverted by the dwelling under the floor and re-dispersed onto the terrain surface below.

7. The dwelling as claimed in claim 1, wherein the rain and moisture is diverted via at least one of:

at least one roof periphery gutter;

the at least one wall section;

collectors located substantially level with the floor;

a water storage or detention tank.

8. The dwelling as claimed in claim 6, wherein water collected from the rain and moisture is channelled along a network of irrigation tubing with a plurality of spaced outlets.

9. The dwelling as claimed in claim 8, wherein said irrigation tubing is attached to support joists located underneath the at least one floor section.

10. The dwelling as claimed in claim 6, wherein said rain is diverted via a temporary storage in a detention tank.

11. The dwelling as claimed in claim 10, wherein the detention tank fills to a predetermined level, whereupon any excess collected fluid bypasses, or overspills from the detention tank straight to fluid irrigation outlets beneath the dwelling.

12. The dwelling as claimed in claim 2, securable to said terrain surface by one or more terrain mounts formed as at least one of:

separate, discrete elements, to which the floor section supports are attached, and continuous elements whereby the terrain mounts are incorporated as part of the floor section supports and formed as a single element.

13. The dwelling as claimed in claim 1, formed as a substantially rigid skeletal frame to which said at least one floor section, said at least one wall section and said at least one roof section are attached.

14. The dwelling as claimed in claim 1, wherein the at least one floor section is elevated between 0.3-1.5 m above the terrain surface.

15. The dwelling as claimed in claim 12, wherein at least part of the at least one floor section is elevated between 0.5-1.1 m above the terrain surface.

16. The dwelling as claimed in claim 1, wherein at least 50% of said floor is transparent.

17. The dwelling as claimed in claim 1, wherein at least 50% of said roof is transparent.

18. The dwelling as claimed in claim 1, wherein at least 50% of said at least one wall is transparent.

19. The dwelling as claimed in claim 1, wherein said irrigation distribution system includes one or more apertured conduits, drippers, sprinklers.

* * * * *